US005700630A

United States Patent [19]

Inoue et al.

[11] Patent Number: 5,700,630

[45] Date of Patent: Dec. 23, 1997

[54] SILVER HALIDE PHOTOGRAPHIC MATERIAL AND METHOD FOR PROCESSING THE SAME

[75] Inventors: Rikio Inoue; Sumito Yamada, both of Kanagawa, Japan

[73] Assignee: Fuji Photo Film Co., Ltd., Kanagawa, Japan

[21] Appl. No.: 609,282

[22] Filed: Mar. 1, 1996

[30] Foreign Application Priority Data

Mar. 3, 1995 [JP] Japan ..... HEI. 7-44006
Mar. 30, 1995 [JP] Japan ..... HEI. 7-73720.

[51] Int. Cl.[6] ..... G03C 1/83; G03C 1/34; G03C 5/16; G03C 5/31

[52] U.S. Cl. ..... 430/399; 430/403; 430/435; 430/440; 430/441; 430/442; 430/522; 430/536; 430/537; 430/539; 430/611; 430/950; 430/944; 430/963; 430/966

[58] Field of Search ..... 430/522, 531, 430/536, 537, 584, 966, 944, 539, 611, 950, 963, 403, 399, 435, 440, 441, 442

[56] References Cited

U.S. PATENT DOCUMENTS

| | | | |
|---|---|---|---|
| H1508 | 12/1995 | Hirano | 430/435 |
| 4,839,265 | 6/1989 | Ohno et al. | 430/588 |
| 5,162,195 | 11/1992 | Inagaki | 430/522 |
| 5,445,930 | 8/1995 | Harada et al. | 430/588 |
| 5,503,965 | 4/1996 | Okutsu | 430/435 |

FOREIGN PATENT DOCUMENTS

| | | | |
|---|---|---|---|
| 0111848 | 9/1981 | Japan | 430/966 |
| 2123454 | 6/1987 | Japan | 430/522 |
| 62-299959 | 12/1987 | Japan | G03C 1/00 |
| 63-131135 | 6/1988 | Japan | G03C 1/00 |
| 3195655 | 8/1988 | Japan | 430/522 |
| 4-270343 | 9/1992 | Japan | G03C 5/30 |
| 6-19069 | 1/1994 | Japan | G03C 5/30 |

*Primary Examiner*—Richard L. Schilling
*Attorney, Agent, or Firm*—Sughrue, Mion, Zinn, Macpeak & Seas, PLLC

[57] ABSTRACT

A silver halide photographic material is disclosed which comprises a support having thereon at least one light-sensitive silver halide emulsion layer containing silver halide grains, a surface protective layer as an uppermost layer, and a hydrophilic colloid layer other than said at least one light-sensitive silver halide emulsion layer and said surface protective layer, wherein the sum of the silver amount contained in each of said at least one light-sensitive silver halide emulsion layer is from 0.8 g/m$^2$ to 1.5 g/m$^2$ on one side of said support; said hydrophilic colloid layer other than said at least one light-sensitive silver halide emulsion layer and said surface protective layer contains a non-elusive solid fine grain dispersion dye represented by formula (I); and a mercapto compound represented by formula (II) is contained in at least one of any hydrophilic colloid layer:

(I)

(II)

20 Claims, No Drawings

SILVER HALIDE PHOTOGRAPHIC MATERIAL AND METHOD FOR PROCESSING THE SAME

FIELD OF THE INVENTION

The present invention relates to a silver halide photographic material and, in particular, relates to, when processing a black-and-white silver halide photographic material with an automatic processor, a technique in which the contamination of processing solutions and the failure according thereto are less in a processing system of a reduced waste solution, a safelight adaptability is excellent, and a detectability corresponding to infrared sensors used in various automatic transporting apparatuses is imparted to a photographic material.

The present invention relates to a silver halide photographic material and a method for processing the same and, in particular, relates to a silver halide photographic material suitable to be used in a processing system with a compact type automatic processor for a medical X-ray photograph or in a processing system which generates an extremely small amount of waste solution, and to a method for processing the same.

BACKGROUND OF THE INVENTION

In recent years, the need of reducing a replenishment rate of a processing solution has been increased as well as the need for rapid processing. Accordingly, nowadays, reducing the coating amount of silver has been a big trend. When the coating amount of silver is reduced, a light-shielding ability of an infrared sensor of an automatic transporting system including an automatic processor reduces, therefore, the detection of the position of a photographic material becomes impossible resulting in the failure of the transportation of a photographic material.

There is disclosed in JP-A-62-299959 (the term "JP-A" as used herein means an "unexamined published Japanese patent application") a method of improving the impossibility of the detection caused by using a certain kind of an infrared-absorbing dye. According to this method, however, it is necessary for a dye to be adsorbed onto a silver halide grain specially, which imposes a load on processing (in particular, fixing), and complicates coat handling. Also, a dye per se has an absorption in a visible region. Therefore, this method is problematic in a black-and-white photographic material in which a silver image is observed. JP-A-63-131135 discloses a method of improving the impossibility of the detection by using a light scattering grain such as a silver halide grain. However, since this method only makes use of refractive indices, a light-shielding effect to an infrared sensor is small and a load is imposed on fixing in case of a silver halide grain. Therefore, when a replenishment rate is reduced and rapid processing is carried out, it is very hard to improve the impossibility of the detection.

Solid dispersion dyes which are excellent in decolorability by processing have been developed to cope with the rapid processing trend in recent years.

Detective dyes for a sensor have to satisfy the following conditions.

(1) They have an appropriate spectral absorption corresponding to an infrared sensor.

(2) They are photochemically inactive. That is, they should not adversely affect the performances of a silver halide photographic emulsion such as sensitivity, fading of the latent image, or fog.

(3) They do not leave detrimental coloring on a photographic material after being processed.

(4) They are excellent in the stability with the lapse of time in a solution or in a photographic material.

In particular, decolorable dyes have been used to satisfy condition (3), but when decolorable dyes are used, needs such as rapid processing and the reduction of a replenishment rate of a processing solution cannot be satisfied, further, since decolorable dyes often diffuse into other layers, condition (2) cannot be met under the existing circumstances.

Further, there are problems such that dyes diffused into other layers or dyes previously added to a surface protective layer are transferred to the roller of an automatic processor or a fluorescent intensifying screen to which a photographic material is contacted and cause contamination.

In recent years, in a medical field, the reduction of waste solutions has been strongly desired from the point of environmental protection and saving spaces. For that purpose, it has been necessary to increase the activity of processing solutions, therefore, the increase of the amounts of a developing agent and a developing agent assistant in a developing solution and raising pH of a developing solution have been tried.

However, in general, a developing solution is liable to be deteriorated by oxidation with the increase of its activity and the processing stability is degraded. Accordingly, there are presumably limits in the extreme reduction of a replenishment rate of a developing solution and the reduction of a waste solution only by the improvement of a developing solution.

Techniques which use ascorbic acids as a novel developing agent in place of hydroquinones which have conventionally been used as a developing agent in black-and-white development have been already known. Specific examples thereof are disclosed in JP-A-4-270343 and JP-A-6-19069.

Photographic materials having high processing stability and applicable to processing under extreme reduction of a replenishment rate of a developing solution and to a novel developing solution have been desired.

Moreover, in a processing system with an automatic processor, rapid processing, miniaturization of a processor and the reduction of consumed electric power have been strongly desired. A washing processed photographic material is, in general, dried with hot air to evaporate water. It is advantageous to increase the degree of hardening of a photographic material and decrease the water content at water washing for the purpose of drying films rapidly.

However, when the degree of hardening of a photographic material is increased, photographic performances of the photographic material are extremely deteriorated in the processing method as described above and there arise new problems such that low sensitization and low contrast due to insufficient development in a high density region occur.

SUMMARY OF THE INVENTION

Accordingly, a first object of the present invention is to provide a silver halide photographic material having a detectability corresponding to detective sensors of a photographic material of various automatic transporting apparatuses in a method of processing a silver halide photographic material of a less coated amount of silver using an automatic processor with a reduced amount of replenisher (that is, generating a less waste solution).

A second object of the present invention is, in addition to the first object, to provide a silver halide photographic material which does not contaminate processing tanks and processing solutions when processing is carried out using an automatic processor with a reduced replenishment rate.

A third object of the present invention is, in addition to the first and second objects, to provide a silver halide photographic material in which the increase of fog under a safelight (a darkroom lamp) is less and the contamination by the transfer of a dye is improved.

A fourth object of the present invention is to provide a silver halide photographic material which provides good photographic performances and a drying ability in rapid processing and/or development processing with an extremely reduced replenishment rate, and a method for processing the same.

The above objects of the present invention have been attained by the following means.

(1) A silver halide photographic material comprising a support having thereon at least one light-sensitive silver halide emulsion layer, a surface protective layer as an uppermost layer, and a hydrophilic colloid layer other than these layers, wherein the total coating amount of silver of a light-sensitive silver halide emulsion layer coated on said support is from 0.8 g/m$^2$ to 1.5 g/m$^2$ per one side, the hydrophilic colloid layer other than the light-sensitive silver halide emulsion layer and the surface protective layer contains a non-elusive solid fine grain dispersion dye represented by formula (I), and at least one hydrophilic colloid layer on the support contains a mercapto compound represented by formula (II):

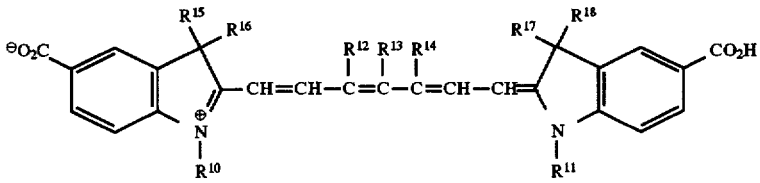

(I)

wherein $R^{10}$ and $R^{11}$ each represents an alkyl group, an aralkyl group or an alkenyl group; $R^{12}$ and $R^{14}$ each represents a hydrogen atom or an atomic group necessary to form a 5- or 6-membered ring by linking with each other; $R^{13}$ represents an aryl group, —N($R^{19}$)($R^{20}$), —S$R^{21}$ or —O$R^{22}$; $R^{19}$ represents a hydrogen atom, an alkyl group or an aryl group; $R^{20}$ represents an aryl group, a sulfonyl group or an acyl group; $R^{19}$ and $R^{20}$ may be linked with each other to form a ring; $R^{21}$ and $R^{22}$ each represents an aryl group; and $R^{15}$, $R^{16}$, $R^{17}$ and $R^{18}$ each represents an alkyl group, and $R^{15}$ and $R^{16}$, and $R^{17}$ and $R^{18}$ may be linked with each other to form a ring;

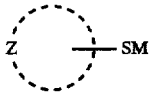

(II)

wherein Z represents a heterocyclic ring having at least one of —$SO_3M$, —$COOR_1$, —OH and —$NHR_2$ directly or indirectly; M represents a hydrogen atom, an alkali metal atom, or a quaternary ammonium group or a quaternary phosphonium group; $R_1$ represents a hydrogen atom, an alkali metal atom, or an alkyl group having from 1 to 6 carbon atoms; $R_2$ represents a hydrogen atom, an alkyl group having from 1 to 6 carbon atoms, —$COR_3$, —$COOR_3$ or —$SO_2R_3$; and $R_3$ represents a hydrogen atom, an aliphatic group or an aromatic group.

On the other hand, in general, a matting agent is used in a photographic material. A matting agent is, as disclosed in JP-A-51-6017, JP-A-61-20028 and JP-A-53-7231, a grain having important functions which is used for purposes of preventing adhesion, static marks and scratches which are generated when the surface protective layer of a photographic material is brought into contact with other substances, and giving slipperiness to the surface of a photographic material. However, while a matting agent gives indispensable functions to a photographic material, it has a problem such that it peels off from the surface of a photographic material during processing in an automatic processor and contaminates the inside of a processing tank, in particular, in a processing system of a reduced waste solution.

In the present invention, such a problem is resolved by (2) the silver halide photographic material as described in (1) above, wherein the surface protective layer contains alkali-insoluble synthetic polymer grains represented by the following formula (III):

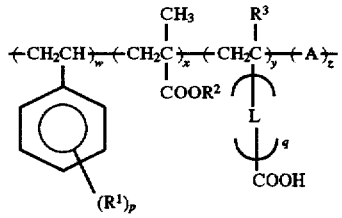

(III)

wherein $R^1$ represents a methyl group or a halogen atom; $R^2$ represents a methyl group or an ethyl group; $R^3$ represents a hydrogen atom or a methyl group; L represents a divalent linking group; A represents an ethylenically unsaturated monomer, provided that two or more double bonds are not contained in one monomer; p represents 0, 1 or 2; q represents 0 or 1; w represents from 3 to 60 mol %; x represents from 30 to 96.5 mol %; y represents from 0.5 to 25 mol %; z represents from 0 to 30 mol %, and w+x+y+z=100 mol %.

(3) The silver halide photographic material as described in (1), wherein light-sensitive silver halide grains in said silver halide emulsion layer are sensitized with a selenium compound, and a ratio of swelling of the entire hydrophilic colloid layers present on the side of the support on which the emulsion layer is provided is from 130% to 200%.

(4) The silver halide photographic material as described in (3), wherein 50% to 100% of the projected area of the silver halide grains contained in said emulsion layer accounts for tabular silver halide grains having an aspect ratio of from 3 to 30.

(5) The silver halide photographic material as described in (3) or (4), wherein the average grain size corresponding to a circle of the projected area of each of said light-sensitive silver halide grains is from 0.1 μm to 0.8 μm.

(6) The silver halide photographic material as described in (3), (4) or (5), wherein the silver halide photographic material comprises a layer containing a non-elusive electrically conductive component.

(7) A method for processing a silver halide photographic material with an automatic processor, wherein a developing solution contains a developing agent represented by the following formula (I') and does not contain hydroquinones, and the photographic material described in (3), (4), (5) or (6) is developing processed with a developing time of from 5 seconds to 30 seconds:

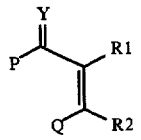

(I')

wherein R1 and R2 each represents a hydroxyl group, an amino group, a mercapto group or an alkylthio group; P and Q each represents a hydroxyl group, a carboxyl group, an alkoxyl group, a hydroxyalkyl group, a carboxyalkyl group, a sulfo group, a sulfoalkyl group, an amino group, an alkyl group or an aryl group, or P and Q each represents an atomic group necessary to form a 5- to 8-membered ring by connecting with each other together with two vinyl carbon atoms substituted with R1 and R2 and the carbon atom substituted with Y; Y represents =O or =N—R3; and R3 represents a hydrogen atom, a hydroxyl group, an alkyl group, an acyl group, a sulfoalkyl group or a carboxyalkyl group.

(8) The method for processing a silver halide photographic material as described in (7), wherein a replenishment amount of the developing solution is from 25 ml to 200 ml per $m^2$ of said photographic material.

DETAILED DESCRIPTION OF THE INVENTION

The present invention is described in detail below.

Formula (I) is described in detail below.

The alkyl group represented by $R^{10}$, $R^{11}$, $R^{15}$, $R^{16}$, $R^{17}$, $R^{18}$ and $R^{19}$ is an unsubstituted alkyl group preferably having from 1 to 10, more preferably from 1 to 6, carbon atoms (e.g., methyl, ethyl, propyl, butyl, isobutyl, pentyl, hexyl). $R^{15}$ and $R^{16}$, and $R^{17}$ and $R^{18}$ may be linked with each other to form a ring (e.g., cyclopentene, cyclohexane).

The aralkyl group represented by $R^{10}$ and $R^{11}$ is preferably an aralkyl group having from 7 to 12 carbon atoms (e.g., benzyl, phenethyl), and may have a substituent (e.g., methyl, carboxyl, alkoxyl, chlorine atom).

The alkenyl group represented by $R^{10}$ and $R^{11}$ is preferably an alkenyl group having from 2 to 10 carbon atoms (e.g., 2-pentenyl, vinyl, allyl, 2-butenyl, 1-propenyl).

The aryl group represented by $R^{13}$, $R^{19}$, $R^{20}$, $R^{21}$ and $R^{22}$ is an aryl group preferably having from 6 to 12 carbon atoms (e.g., phenyl, naphthyl). The aryl group may be substituted and any group may be used as a substituent provided that it does not dissolve a dye during development processing, for example, a methyl group, an ethyl group, a chorine atom, a methoxy group or a methoxycarbonyl group can be enumerated as a substituent.

The sulfonyl group represented by $R_{20}$ is preferably an alkylsulfonyl group or an arylsulfonyl group each having from 1 to 10 carbon atoms, for example, a mesyl group, a tosyl group, a benzenesulfonyl or an ethanesulfonyl group.

The acyl group represented by $R^{20}$ is preferably an alkylacyl group or an arylacyl group each having from 2 to 10 carbon atoms, for example, an acetyl group, a propionyl group or a benzoyl group.

$R^{10}$ and $R^{11}$ preferably represent an alkyl group.

$R^{12}$ and $R^{14}$ preferably represent the case where they are linked to form a 5- or 6-membered ring.

$R^{13}$ preferably represents $—N(R^{19})(R^{20})$, $—SR^{21}$ or $—OR^{22}$, and particularly preferably $—N(R^{19})(R^{20})$.

$R^{19}$ preferably represents an alkyl group or an aryl group.

In $—N(R^{19})(R^{20})$ represented by $R^{13}$, either of $R^{19}$ or $R^{20}$ is preferably an aryl group, and more preferably both of $R^{19}$ and $R^{20}$ are aryl groups. $R^{19}$ and $R^{20}$ most preferably represent a phenyl group.

A preferred combination is the case where $R^{10}$ and $R^{11}$ each represents an alkyl group and $R^{13}$ represents $—N(R^{19})(R^{20})$, $—SR^{21}$ or $—OR^{22}$, more preferred is the case where $R^{12}$ and $R^{14}$ are linked to form a 5- or 6-membered ring and $R^{13}$ represents $—N(R^{19})(R^{20})$, wherein particularly preferably either of $R^{19}$ or $R^{20}$ represents an aryl group, and most preferably, above all, both of $R^{19}$ and $R^{20}$ represent aryl groups.

Specific examples of the dyes according to the present invention are shown below but the present invention is not limited thereto.

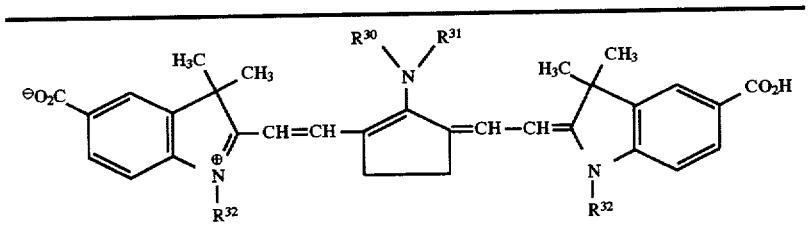

| Compound | $R^{30}$ | $R^{31}$ | $R^{32}$ |
|---|---|---|---|
| 1 | 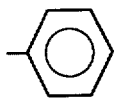 | 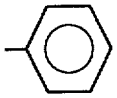 | $CH_3$ |
| 2 | 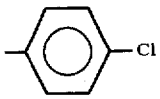 | 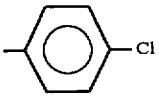 | $CH_3$ |

-continued
| | | | |
|---|---|---|---|
| 3 | 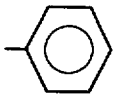 | $CH_3$ | $CH_3$ |
| 4 | 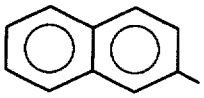 | $C_2H_5$ | $C_2H_5$ |
| 5 | $CH_3$ | 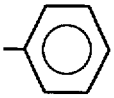 | n-$C_4H_9$ |
| 6 | 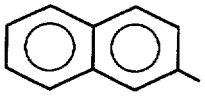 | 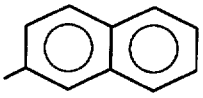 | $CH_3$ |
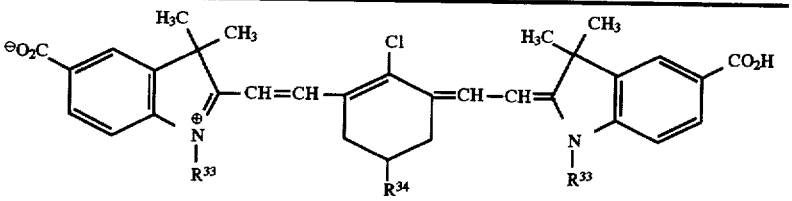
| Compound | $R^{33}$ | $R^{34}$ |
|---|---|---|
| 7 | n-$C_4H_9$ | $CH_3$ |
| 8 | " | t-$C_4H_9$ |
| 9 | " | 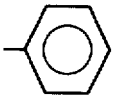 |
| 10 | $C_3H_7$ | 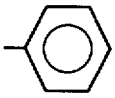 |
| 11 | n-$C_6H_{13}$ | t-$C_4H_9$ |
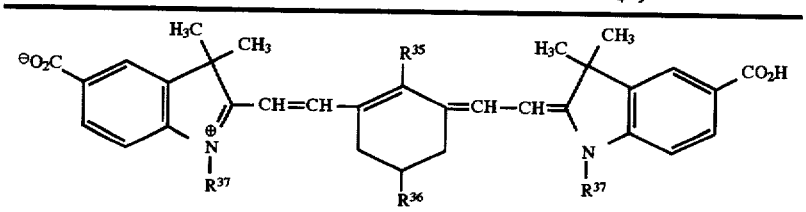
| Compound | $R^{35}$ | $R^{36}$ | $R^{37}$ |
|---|---|---|---|
| 12 | 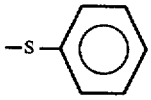 | $CH_3$ | $CH_3$ |
| 13 | " | t-$C_4H_9$ | " |
| 14 | 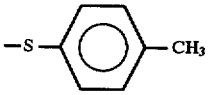 | 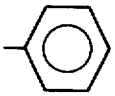 | " |
| 15 | 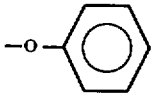 | t-$C_4H_9$ | " |

-continued
| | | | |
|---|---|---|---|
| 16 | 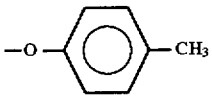 | 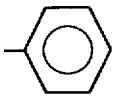 | " |
| 17 | 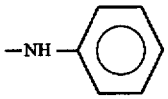 | t-$C_4H_9$ | " |
| 18 | 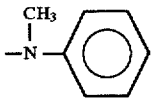 | " | " |
| 19 | 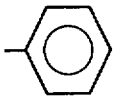 | H | $C_4H_9$ |
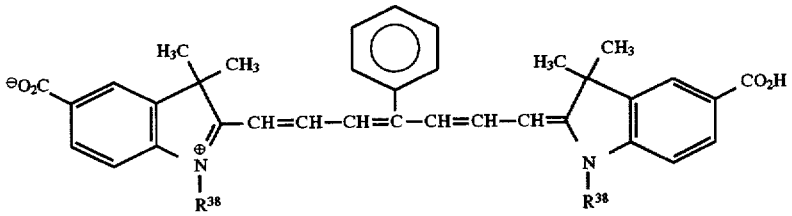
| Compound | $R^{38}$ |
|---|---|
| 20 | $CH_3$ |
| 21 | $C_2H_5$ |
| 22 | n-$C_3H_7$ |
| 23 | n-$C_4H_9$ |
| 24 | n-$C_5H_{11}$ |
| 25 | n-$C_6H_{13}$ |
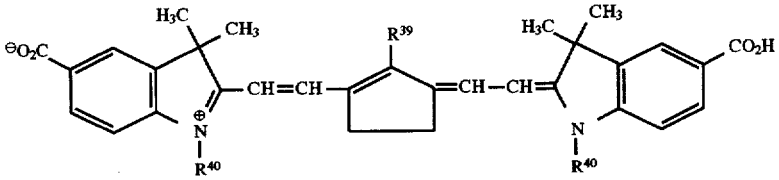
| Compound | $R^{39}$ | $R^{40}$ |
|---|---|---|
| 26 | 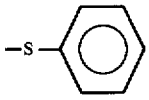 | n-$C_4H_9$ |
| 27 | 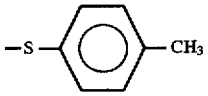 | " |
| 28 | 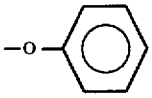 | " |
| 29 | 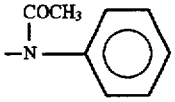 | $CH_3$ |

-continued
30
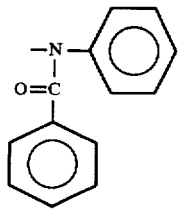
$CH_3$
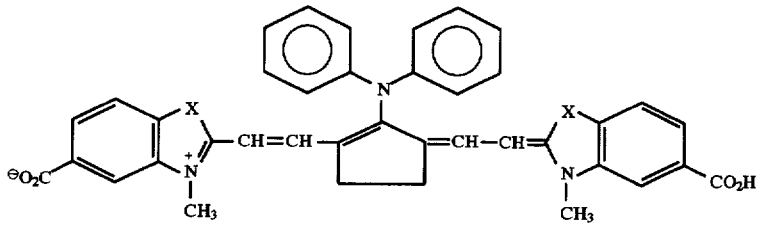
| Compound | X |
|---|---|
| 31 | O |
| 32 | S |
| 33 | N−$CH_3$ |
Compound 34
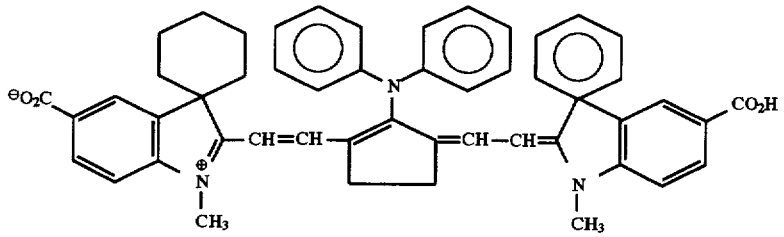
Compound 35
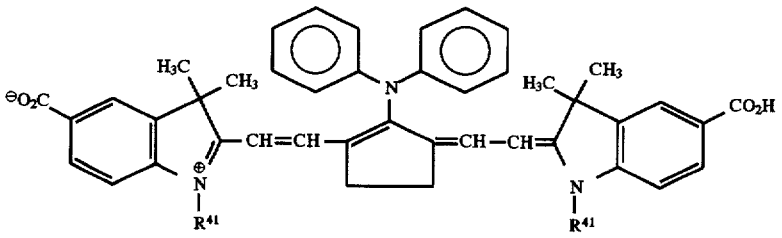
$R^{41}$ = −$CH_2$−CH=$CH_2$
Compound 36
$R^{41}$ = −$CH_2$−
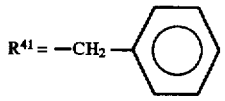
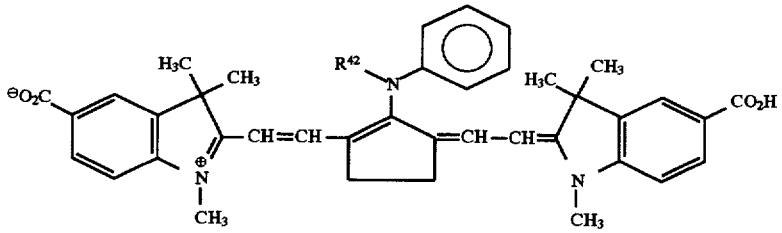

-continued

Compound 37

$R^{42} = -SO_2CH_3$

Compound 38

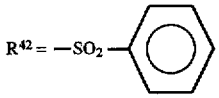

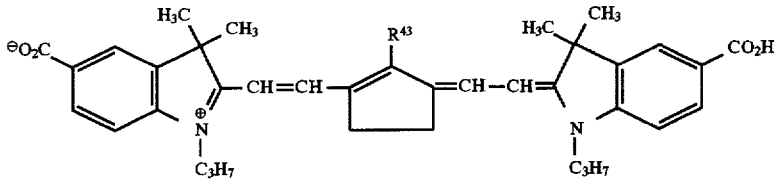

| Compound | $R^{43}$ |
|---|---|
| 39 | 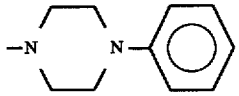 |
| 40 | 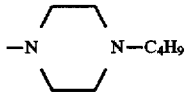 |
| 41 | 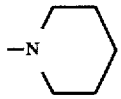 |
| 42 | Cl |

The dyes represented by formula (I) according to the present invention (hereinafter, the dye according to the present invention) can be synthesized making reference to U.S. Pat. Nos. 3,671,648, 2,095,854, JP-A-6-43583 and the following synthesis example.

Synthesis of Compound 1

9.8 g of 1,2,3,3-tetramethyl-5-carboxyindolenium p-toluenesulfonate, 6 g of 1-[2,5-bis(anilinomethylene) cyclopentylidene]diphenylanilinium tetrafluoroborate, 100 ml of ethyl alcohol, 5 ml of acetic anhydride and 10 ml of triethylamine were stirred for one hour at outer temperature of 100° C., and the crystals precipitated were filtrated. The crystals obtained were recrystallized with 100 ml of methyl alcohol to obtain 7.3 g of Compound 1.

Melting Point: 270° C. or more

λmax: 809.1 nm

ε: $1.57\times10^5$ (dimethyl sulfoxide)

Other compounds can also be synthesized in the same manner.

The dye according to the present invention is preferably a non-elusive dye, that is, a dye the spectra of which before and after development processing substantially do not change.

Further, λmax of the dye according to the present invention in a photographic material is about from 700 to 1,100 nm, preferably from 800 to 1,000 nm, and more preferably from 850 to 950 nm, and the absorption in the visible region is a little and photographically harmless.

The dye according to the present invention is used in the form of a solid fine grain dispersion.

The solid fine grain dispersion of the dye according to the present invention can be produced using dispersers disclosed in JP-A-52-92716 and WO 88/074794, e.g., a ball mill, a vibrating ball mill, a planetary ball mill, a sand mill, a colloid mill, a jet mill, a roller mill, etc., and a vertical or horizontal medium disperser is preferably used.

In any cases, a solvent (e.g., water, alcohol) may be present together and, further, a surfactant for dispersion is preferably used. As such a surfactant for dispersion, the anionic surfactants disclosed in JP-A-52-92716 and WO 88/074794 are primarily used. In addition, an anionic polymer, a nonionic or cationic surfactant can be used. Preferred is an anionic surfactant.

Further, after dissolving the dye according to the present invention in an appropriate solvent, a poor solvent for the dye according to the present invention may be added to obtain a fine grain powder. In this case also the above-described surfactant for dispersion may be used. Moreover, it is possible that at first the dye is dissolved by controlling the pH, and then microcrystallized by varying the pH.

The finely dispersed grains of the dye according to the present invention in the dispersion have an average grain size of from 0.005 μm to 10 μm, preferably from 0.01 μm to 1 μm, more preferably from 0.01 μm to 0.5 μm, and in some case an average grain size of from 0.01 μm to 0.1 μm is preferred.

The solid fine grain dispersion of the dye according to the present invention is used by coating in an amount of from 0.001 g/m$^2$ to 1 g/m$^2$, preferably from 0.005 g/m$^2$ to 0.5 g/m$^2$, and particularly preferably from 0.005 g/m$^2$ to 0.1 g/m$^2$.

The hydrophilic colloid layers to which the solid fine grain dispersion of the dye according to the present invention is added should not be a surface protective layer (an uppermost layer) and an emulsion layer. If the dye dispersion is added to a surface protective layer (an uppermost layer), there are disadvantages such that the dye is transferred to the rollers of an automatic transporting apparatus and an automatic processor or between adjacent photographic materials.

On the other hand, if the dye dispersion is added to a silver halide emulsion layer, a partially dissolved dye is adsorbed onto silver halide and color sensitized, which often degrades a safelight ability and causes desensitization in a wavelength region of exposure.

The layers to which the dye dispersion according to the present invention is added are hydrophilic colloid layers such as an interlayer between a surface protective layer and an emulsion layer, interlayers provided between a plurality of emulsion layers, an underlayer provided between an emulsion layer and an undercoat layer of a support, or an undercoat layer of a support per se.

The coating amount of gelatin in the layer containing the dye dispersion is preferably from 0.02 $g/m^2$ to 1 $g/m^2$, more preferably from 0.1 $g/m^2$ to 0.6 $g/m^2$.

The present invention is applicable to black-and-white silver halide photographic materials such as photographic materials for printing, photographic materials for a microfilm, medical X-ray photographic materials, industrial X-ray photographic materials, general negative photographic materials, etc., general reversal photographic materials, and general color negative photographic materials and general color reversal photographic materials. The present invention is preferably applied to medical X-ray photographic materials.

The coating amount of silver of the photographic material according to the present invention, in particular, the X-ray photographic material (in a case of both-sided emulsion film), is preferably from 0.8 $g/m^2$ to 1.5 $g/m^2$ (per one side) and more preferably from 1.0 $g/m^2$ to 1.3 $g/m^2$ (per one side).

As optical sensors, light-receiving elements having a light-receiving sensitivity peak in the vicinity of 900 nm and a sensitivity region at about 700 nm to 1,200 nm are used in combination, with light emitting diodes and semiconductor lasers of emission wavelength at 700 nm or more being light sources. As a light emitting diode, GL-514 (manufactured by Sharp Co., Ltd.) and TLN108 (manufactured by Toshiba Co., Ltd.), and as a light-receiving element, PT501 (manufactured by Sharp Co., Ltd.) and TPS601A (manufactured by Toshiba Co., Ltd.) can be enumerated.

Automatic apparatuses using such optical systems are commercially available from these companies.

The compound represented by formula (II) is described in detail below.

In formula (II), Z represents a heterocyclic residue bonded with at least one selected from $—SO_3M$, $—COOR_1$, —OH and $—NHR_2$ directly or indirectly, e.g., an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring, or a thiodiazine ring, or a ring bonded with other carbon ring or a heterocyclic ring, e.g., a benzothiazole ring, a benzotriazole ring, a benzimidazole ring, a benzoxazole ring, a benzoselenazole ring, a naphthoxazole ring, a triazaindolizine ring, a diazaindolizine ring, or a tetraazaindolizine ring.

Preferred heterocyclic residues include an imidazole ring, a tetrazole ring, a benzimidazole ring, a benzothiazole ring, a benzoxazole ring, and a triazole ring.

In formula (II), M represents a hydrogen atom, an alkali metal atom, a quaternary ammonium group or a quaternary phosphonium group; $R_1$ represents a hydrogen atom, an alkali metal atom, or an alkyl group having from 1 to 6 carbon atoms; $R_2$ represents a hydrogen atom, an alkyl group having from 1 to 6 carbon atoms, $—COR_3$, $—COOR_3$ or $—SO_2R_3$; and $R_3$ represents a hydrogen atom, an aliphatic group (e.g., carboxyethyl, sulfoethyl) or an aromatic group (e.g., phenyl, 4-sulfophenyl), and these groups may further have substituents.

Specific examples of the compounds represented by formula (II) which are preferably used in the present invention are shown below.

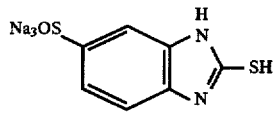

(1)

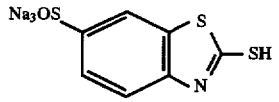

(2)

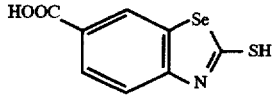

(3)

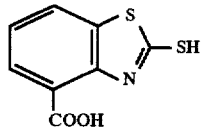

(4)

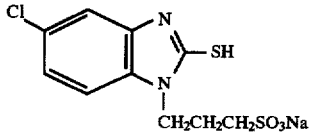

(5)

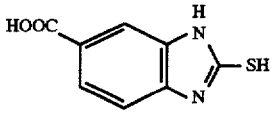

(6)

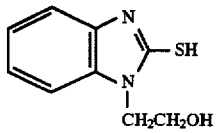

(7)

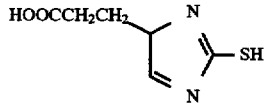

(8)

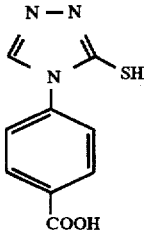

(9)

-continued
(10)
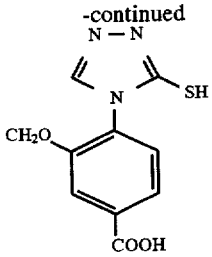
(11)
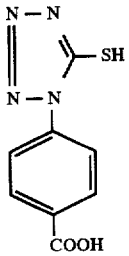
(12)
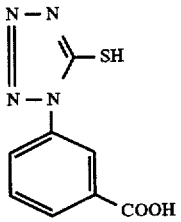
(13)
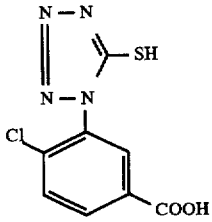
(14)
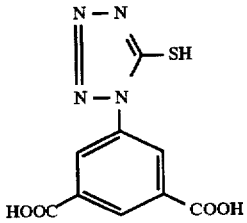
(15)
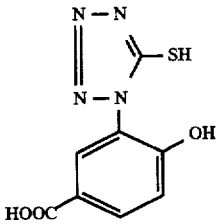
(16)
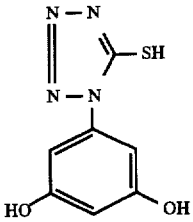
-continued
(17)
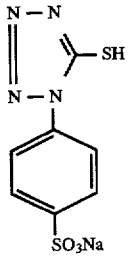
(18)
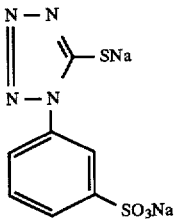
(19)
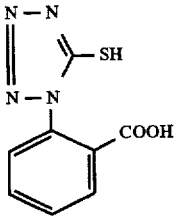
(20)
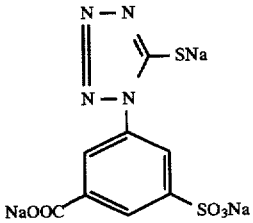
(21)
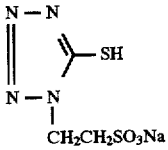
(22)
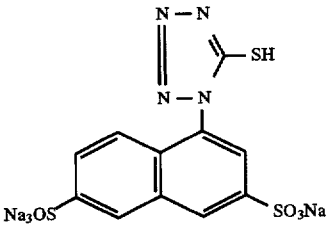
(23)
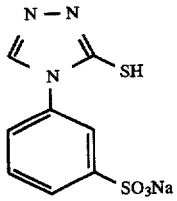

-continued
(24)
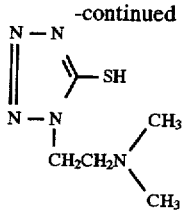
(25)
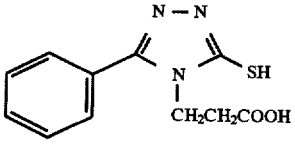
(26)
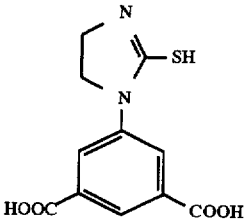
(27)
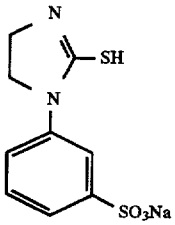
(28)
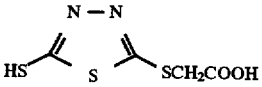
(29)
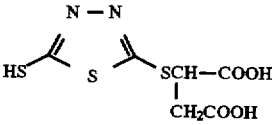
(30)
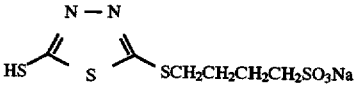
(31)
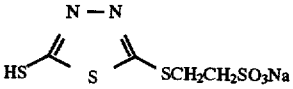
(32)
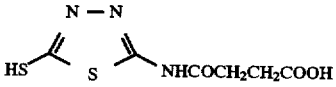
(33)
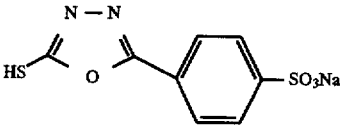
(34)
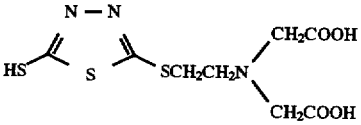
-continued
(35)
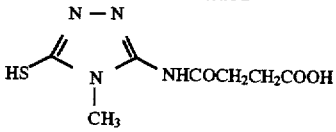
(36)
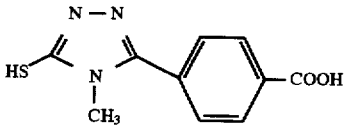
(37)
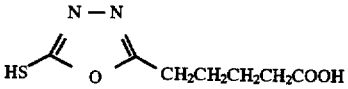
(38)
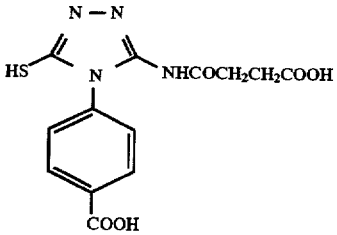
(39)
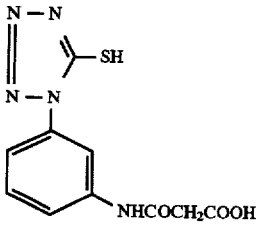
(40)
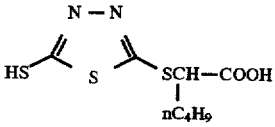
(41)
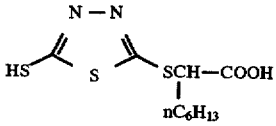
(42)
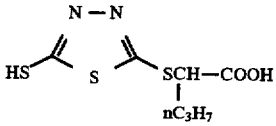
(43)
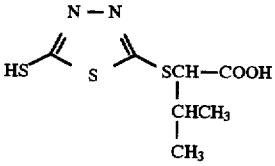
(44)
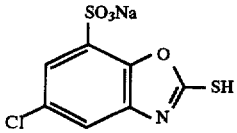

-continued (45)

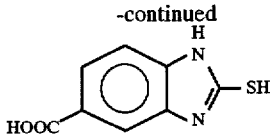

(46)

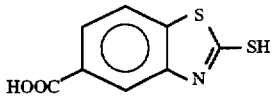

(47)

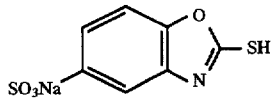

(48)

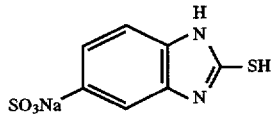

(49)

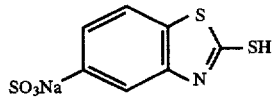

(50)

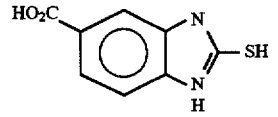

Compounds represented by formula (II) are known compounds and can be synthesized according to the methods disclosed in the following literature.

U.S. Pat. Nos. 2,585,388, 2,541,924, JP-B-42-21842 (the term "JP-B" as used herein means an "examined Japanese patent publication"), JP-A-53-50169, British Patent 1,275,701, D. A. Berges, et al., *Journal of Heterocyclic Chemistry*, Vol. 15, No. 981 (1978), *The Chemistry of Heterocyclic Chemistry*, "Imidazole and Derivatives, Part I", pp. 336 to 339, *Chemical Abstract*, 58, No. 7921 (1963), p. 394, E. Hoggarth, *Journal of Chemical Society*, pp. 1160 to 1167 (1949), S. R. Saudler, W. Karo, *Organic Functional Group Preparation*, Academic Press, pp. 312 to 315 (1968), M. Chamdon, et al., *Bulletin de la Societe Chimique de France*, 723 (1954), D. A. Shirley, D. W. Alley, *J. Amer. Chem. Soc.*, 79, 4922 (1954), A. Wohl, W. Marchwald, *Ber.*, (German journal of chemistry), Vol. 22, p. 568 (1889), *J. Amer. Chem. Soc.*, 44, pp. 1502 to 1510, U.S. Pat. No. 3,017,270, British Patent 940,169, JP-B-49-8334, JP-A-55-59463, *Advanced in Heterocyclic Chemistry*, West German Patent 2,716,707, *The Chemistry of Heterocyclic Compounds, Imidazole and Derivatives*, Vol. 1, p. 385, *Org. Synth.*, IV, 569 (1963), *Ber.*, 9, 465 (1976), *J. Amer. Chem. Soc.*, 45, 2390 (1923), JP-A-50-89034, JP-A-53-28426, JP-A-55-21007 and JP-B-40-28496.

The compound represented by formula (II) is sufficient to be contained in any one layer on a support. For example, a silver halide emulsion layer or other hydrophilic colloid layers (an interlayer, a surface protective layer, a yellow filter layer, an antihalation layer) can be cited. The compound represented by formula (II) can be added to a silver halide emulsion layer, a layer containing a fine grain dispersion of the dye according to the present invention, or adjacent layers thereto, but is preferably added to layers other than emulsion layers because photographic desensitization is less.

The addition amount of the compound represented by formula (II) is preferably from $1\times10^{-5}$ to $1\times10^{-1}$ g/m$^2$, more preferably from $5\times10^{-5}$ to $5\times10^{-2}$ g/m$^2$, and particularly preferably from $1\times10^{-3}$ to $1\times10^{-2}$ g/m$^2$.

The addition of the compound to an emulsion is conducted according to ordinary addition methods of additives for a photographic emulsion. For example, the compound is dissolved in methyl alcohol, ethyl alcohol, methyl cellosolve, acetone, water, or mixed solvent of them and can be added to an emulsion in the form of a solution.

Further, the compound represented by formula (II) can be added at any stage of the production of a photographic emulsion or can be added at any stage after the production of an emulsion and just before coating.

The compound represented by formula (II) is extremely effective for preventing the deterioration of a safelight ability of a photographic material due to an infrared dye.

Formula (III) is described in detail below.

L represents a divalent linking group and is preferably a group represented by the following formula (IV):

$$-(CO-X^1)_r-X^2- \quad \text{(IV)}$$

wherein $X^1$ represents an oxygen atom or $-NR^4-$; $R^4$ represents a hydrogen atom, an alkyl group, an aryl group or an acyl group, and each of these groups may have a substituent (e.g., halogen, nitro, hydroxyl). Preferred examples of $R^4$ include a hydrogen atom, an alkyl group having from 1 to 10 carbon atoms (e.g., methyl, ethyl, n-butyl, n-octyl), and an acyl group (e.g., acetyl, benzoyl). $X^1$ particularly preferably represents an oxygen atom or —NH—.

r represents 0 or 1.

$X^2$ represents alkylene, arylene, alkylenearylene, arylenealkylene, or alkylenearylenealkylene, and —O—, —S—, —OCO—, —CO—, —COO—, —NH—, $-SO_2-$, $-N(R^5)-$, $-N(R^5)SO_2-$, etc., may be inserted in these alkylene, arylene, alkylenearylene, arylenealkylene, or alkylenearylenealkylene. $R^5$ represents a straight chain or branched alkyl group having from 1 to 6 carbon atoms, e.g., methyl, ethyl or isopropyl. As preferred examples of $X^2$, there can be enumerated dimethylene, trimethylene, tetramethylene, o-phenylene, m-phenylene, p-phenylene, $-CH_2CH_2OCOCH_2CH_2-$, and $-CH_2CH_2OCO(C_6H_4)-$.

Preferred examples of the polymers represented by formula (III) are shown below (the composition is shown in a mol ratio), but the present invention is not limited thereto.

Hereinafter, St represents styrene, MMA represents methyl methacrylate, EMA represents ethyl methacrylate, MA represents methacrylic acid, and AA represents acrylic acid.

(P-1) St (20), MMA (70), MA (10)
(P-2) St (15), MMA (75), MA (10)
(P-3) St (55), MMA (25), MA (20)
(P-4) St (30), MMA (65), MA (5)
(P-5) St (7), MMA (90), MA (3)
(P-6) St (25), MMA (70), AA (15)
(P-7) St (40), MMA (55), AA (15)
(P-8) St (20), EMA (70), AA (10)
(P-9) St (10), EMA (75), AA (15)
(P-10St (15), EMA (70), MA (15)
(P-11) St (10), MMA (80), Acryloyloxyethyl-o-phthalic acid (10)
(P-12) St (15), MMA (75), Acryloyloxyethylsuccinate (10)
(P-13) St (18), MMA (75), Acryloyloxyethylsuccinate (7)
(P-14) Cl-St (15), EMA (70), Acryloyloxyethyl-o-phthalic acid (15)
(P-15) p-$CH_3$-St (40), EMA (55), Methacryloyloxyethylsuccinate (5)
(P-16) p-$CH_3$-St (10), MMA (80), MA (10)
(P-17) p-$CH_3$-St (15), MMA (80), MA (5)

(P-18) Cl-St (15), MMA (70), MA (15)
(P-19) Cl-St (3), EMA (92), MA (5)
(P-20) Cl-St (10), MMA (80), AA (10)
(P-21) St (20), MMA (60), MA (10), EMA (10)
(P-22) St (20), MMA (70), MA (5), Butyl acrylate (5)
(P-23) Cl-St (10), EMA (65), MA (15), St (10)

The coating amount of alkali-insoluble synthetic polymer grains (hereinafter referred to as "a matting agent") contained in a surface protective layer is preferably from 0.001 to 0.3 g/m$^2$, particularly preferably from 0.01 to 0.15 g/m$^2$, and the average grain size of the matting agent is preferably from 0.2 to 10 μm, particularly preferably from 2 to 8 μm. In this case, if the matting agent according to the present invention accounts for 50 wt % or more, preferably 70 wt % or more, of the entire coating amount, the effect of the present invention can be exhibited. Further, a matting agent to be used in combination in this case is not particularly limited, for example, an organic compound such as polymethyl methacrylate and polystyrene or an inorganic compound such as silicon dioxide may be used. Moreover, the combined use of two or more of the matting agent of the present invention can also be effective.

It is preferred that 70 wt % or more, preferably 80 wt % or more, and particularly preferably 90 wt % or more, of the entire matting agent used in a photographic material is present in a surface protective layer in the present invention.

As described above, the average grain size of the matting agent of the present invention is preferably 2 μm or more and, in particular, those having grain size distribution maxima in 3 μm or more and 3 μm or less are preferred. This is because a matting agent having a grain size of 3 μm or more controls peeling off of a photographic material, on the other hand, a matting agent having a grain size of 3 μm or less mainly controls the sliding property and glossiness of a photographic material. In general, grains having a grain size of 3 μm or more cause the precipitation of a matting agent in a coating solution and peeling off of a matting agent during processing. The present invention is particularly effective in the composition having a grain size of 3 μm or more.

The matting agent according to the present invention is particularly effective in the reduction of the amount of gelatin in an uppermost layer in designing a photographic material according to high temperature rapid processing, and shows effectiveness to prevent the precipitation of a matting agent in a coating solution and peeling off of a matting agent during processing even when the amount of gelatin in an uppermost layer is preferably from 0.2 g/m$^2$ to 0.7 g/m$^2$, more preferably from 0.3 g/m$^2$ to 0.5 g/m$^2$.

The matting degree of the photographic material containing the matting agent of the present invention is described below.

In the present specification, matting degree means the degree of a so-called "surface roughness". The surface roughness herein means the roughness due to convexities and concavities of a surface occurring with micro-distances and is, in general, a base of a feeling recognized feelingly as "smooth" or "coarse". There are various methods of measuring the matting degree, for example, the observation of the surface conformation with a surface roughness meter, an optical microscope, scanning electron microscope, etc., but as the average surface roughness, Beck's smoothness disclosed in JIS P 8119 can be cited. Beck's smoothness is expressed in seconds of the flow of air of 10 ml under pressure differential of about 370 mmHg when a plate having an effective area of 10 cm$^2$ is pressed against the face to be measured with a pressure of 1 kg/cm$^2$. That is, the larger the number of the second, the smaller is the matting degree, and the smaller the number of the second, the larger is the matting degree. Further, it is preferred to use an air micrometer type tester to measure Beck's smoothness accurately, in particular, Beck's smoothness excellent in reproducibility can easily be obtained using Ohken system smoothness measuring method disclosed in *J. TAPPI Paper Pulp Test Method No.* 5 (Yamamoto, et al., *Journal of Paper Pulp Technical Society*, 20 [2], pp. 17 to 24 (1966)).

Further, the matting degree of either of an emulsion face or a back face may be any as long as a star dust failure does not occur, but Beck's smoothness is preferably 1,000 seconds or less, particularly preferably 300 seconds or less.

It is preferred for the surface protective layer and/or the emulsion layer according to the present invention to contain at least one selected from polyethylene oxide compounds and water-soluble polymers to heighten the effect of the present invention.

As ethylene oxide compounds preferably used in the present invention, compounds represented by formulae [I-1], [I-2] and [I-3], and also compounds represented by formulae (II) and (III) disclosed in JP-A-60-76742 can be cited. Specific examples thereof include Compounds I-1 to 1-68, II-1 to II-18 and III-1 to III-21.

As water-soluble polymers preferably used in the present invention, the disclosure in line 17, left lower column, page 7 to line 9, left lower column, page 10 of JP-A-1-234843, in particular, compounds represented by formula (P), specifically, Compounds P-1 to P-18 of the same patent, and compounds represented by formula (II) of JP-A-1-241537, specifically, Compounds P-1 to P-14 can be enumerated. Further, water-soluble polymers disclosed in JP-A-3-77940 and JP-A-3-246535 can also be used preferably.

As water-soluble polymers, glucose polymers and derivatives thereof are preferred, and starch, glucogen, cellulose, lichenin, dextran, nigeran, etc., are preferred among glucose polymers and derivatives thereof and, in particular, dextran and derivatives thereof can preferably be used.

The molecular weight of these water-soluble polymers is preferably from 1,000 to 100,000 and particularly preferably from 2,000 to 50,000.

The synthetic or water-soluble polymers for use in the present invention are contained in a photographic material in an amount of 10 wt % or more based on the entire coating amount of gelatin, preferably from 10 wt % to 30 wt %.

The silver halide grains for use in the present invention may be grains which grew isotropically such as cubic, octahedral or tetradecahedral grains; polyhedral crystal type such as spherical grains; tabular grains having parallel twin planes and making {111} faces as major faces; or tabular grains having {100} faces as major faces. In particular, tabular grains having parallel twin planes and making {100} faces as major faces or tabular grains having {100} faces as major faces are preferably used as tabular silver halide grains.

Tabular silver halide grains which are preferably used in the present invention are explained in detail below.

The aspect ratio of tabular grains for use in the present invention is the ratio of the diameter of the circle having the equal area to the projected area of an individual tabular grain to the thickness of an individual tabular grain.

The preferred grain form is a grain form having an aspect ratio of 3 or more and less than 20, more preferably 5 or more and less than 15.

The silver halide emulsion in which the tabular grains accounts for 50% or more, more preferably 80% or more, of the entire projected area is preferred.

Tabular silver halide grains can be produced according to well known methods in the art in an arbitrary combination.

Tabular silver halide emulsions are disclosed in Cugnac and Chateau, *Evolution of the Morphology of Silver Bromide Crystals during Physical Ripening*, Science et Industrie Photography, Vol. 33, No. 2 (1962), pp. 121 to 125, Duffin, *Photographic Emulsion Chemistry*, Focal Press, New York, 1966, pp. 66 to 72, and A. P. H. Trivelli, W. F. Smith, *Photographic Journal*, Vol. 80, p. 285 (1940), and can be prepared easily according to the methods disclosed in JP-A-58-127921, JP-A-58-113927 and-JP-A-58-113928.

Specifically, tabular silver halide grains can be produced by forming seed crystals in which the proportion of tabular grains are 40% or more in weight under the atmosphere of comparatively low pBr value of pBr 1.3 or less, while maintaining pBr about the same, adding silver and a halide solution thereto at the same time to grow the seed crystals.

Silver and a halide solution are preferably added to the emulsion so as not to generate new crystal nuclei during the grain growth.

The size of tabular silver halide grains can be controlled by adjusting the temperature, selecting the kind and amount of solvents, and controlling the addition speed of the silver salt and halide for use during grain growth.

In the present invention, monodisperse hexagonal tabular grains are particularly useful grains among tabular silver halide grains.

The structures and producing methods of monodisperse hexagonal tabular grains are disclosed in detail in JP-A-63-151618.

With respect to the silver halide emulsion which is preferably used in the present invention, the average grain size corresponding to the circle of a projected area of silver halide grains is calculated as the average value of all the silver halide grains.

The average grain size corresponding to the circle is preferably from 0.1 μm to 1.2μm, more preferably from 0.1 μm to 0.8 μm, particulary preferably from 0.4 μm to 0.8 μm and most preferably from 0.5 μm to 0.7 μm.

The thickness of tabular silver halide grains is preferably from 0.05 μm to 0.2 μm, more preferably from 0.08 μm to 0.16 μm, and most preferably from 0.1 μm to 0.15 μm.

The silver halide which can be used in the present invention may be any of silver bromide, silver iodobromide, silver iodochlorobromide, silver chlorobromide, and silver chloride. When halide is accumulated in a developing solution, the development inhibition becomes stronger in the order of Cl Br, and I. Therefore, silver bromide and silver chlorobromide are preferably used and more preferably silver chloride. If silver iodide must be used, the amount thereof is preferably as little as possible, preferably from 0 to 1 mol %, more preferably from 0 to 0.3 mol %. As AgI distribution, outermost high concentration type distribution is preferred.

The crystal structure of the silver halide emulsion preferably used in the present invention may be uniform, or the interior and exterior parts of the grains may be comprised of different halogen compositions, or the grains may have a layered structure. Further, it is preferred for the emulsion to contain reduction sensitizing silver nuclei during grain formation.

The so-called halide conversion type grains as disclosed in British Patent 635,841 and U.S. Pat. No. 3,622,318 can particularly effectively be used in the present invention. The amount of halide conversion is preferably from 0.2 mol % to 2 mol %, more preferably from 0.2 mol % to 0.6 mol %, based on the amount of silver.

In a silver iodobromide emulsion, grains of the structure having a high iodide content layer in the inside and/or surface are particularly preferred.

Further, by converting the surface of tabular silver halide grains preferably used in the present invention into a high iodide content type, a more sensitive silver halide emulsion can be obtained.

As the silver halide composition of the surface of a grain before halide conversion, the iodide content is preferably 1 mol % or less, particularly preferably 0.4 mol % or less.

When halide conversion is carried out in the above manner, it is particularly effective to contain a silver halide solvent. Examples of preferred solvents include a thioether compound, thiocyanate, and tetra-substituted thiourea. Above all, a thioether compound and thiocyanate are particularly effective, and thiocyanate is preferably used in an amount of from 0.5 g to 5 g, and a thioether compound is from 0.2 g to 3 g, respectively per mol of the silver halide.

A cadmium salt, a zinc salt, a lead salt, a thallium salt, an iridium salt or a complex salt thereof, a rhodium salt or a complex salt thereof, or an iron salt or a complex salt thereof may be present during silver halide grain formation or physical ripening of silver halide production.

Also, a silver halide solvent such as thiocyanate, a thioether compound, thiazolidineethione and tetra-substituted thiourea may be present during grain formation. Above all, thiocyanate, tetra-substituted thiourea, and a thioether compound are preferred solvents in the present invention.

When the coating amount of the entire hydrophilic colloid is increased, the water content during development processing is increased, which imposes a load on drying step and is not preferred from the viewpoint of rapid processing. Accordingly, the coating amount of the entire hydrophilic colloid according to the present invention is preferably from 1.0 $g/m^2$ to 3.0 $g/m^2$, more preferably from 1.5 $g/m^2$ to 2.5 $g/m^2$, per one face.

In the silver halide photographic material according to the present invention (hereinafter, simply a photographic material), preliminary hardening may be done by adding a hardening agent to a coating solution so that the gelatin in a hydrophilic colloid layer can be crosslinked.

The ratio of swelling of the photographic material of the present invention is preferably from 130% to 200%, more preferably from 140% to 190%, and most preferably from 150% to 180%.

The ratio of swelling in the present invention is according to the same definition as disclosed in JP-A-58-111933.

The selenium compounds disclosed in the patents conventionally well-known can be used as a selenium sensitizer in the present invention. That is, an unstable type selenium compound and/or a non-unstable type selenium compound are usually added and used by stirring an emulsion at a high temperature of preferably 40° C. or more for a certain period of time. The compounds disclosed in JP-B-44-15748, JP-B-43-13489, JP-A-2-130976 and JP-A-4-109240 are preferably used as the unstable selenium compounds. Specific examples of the unstable selenium sensitizers include isoselenocyanates (e.g., aliphatic isoselenocyanates such as allyl isoselenocyanate), selenoureas, selenoketones, selenoamides, selenocarboxylicacids (e.g., 2-selenopropionic acid, 2-selenobutyric acid), selenoesters, diacylselenides (e.g., bis(3-chloro-2,6-dimethoxybenzoyl) selenide), selenophosphates, phosphineselenides, bis (oxycarbonyl)-selenides, and colloidal metal selenium.

Specific examples of the selenium compounds which are preferably used in the present invention are shown below, but the present invention is not limited thereto.

1. 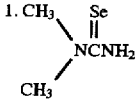
2. 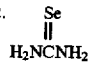
3. 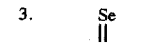
4. 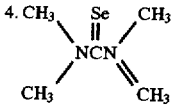
5. 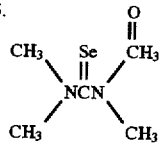
6. 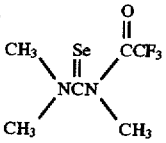
7. 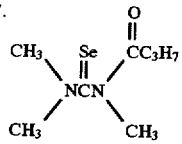
8. 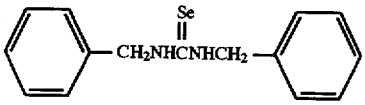
9. 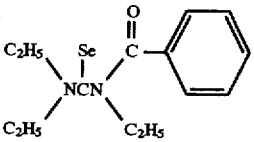
10. 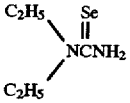
11. 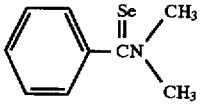
12. 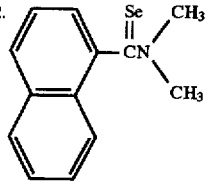
13. 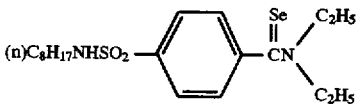
14. 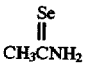
15. 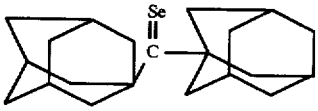
16. 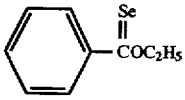
17. 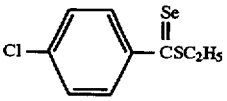
18. 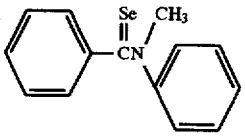
19. 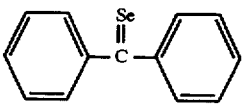
20. 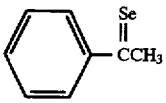
21. 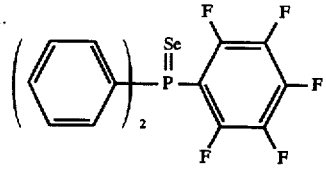
22. 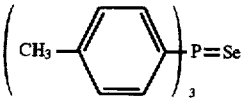
23. $(nC_4H_9)_3P{=}Se$
24. 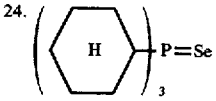
25. 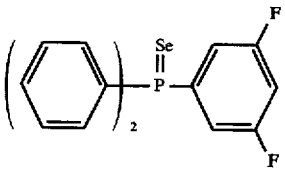
26. 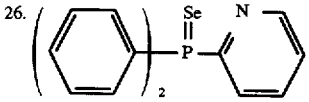
27. 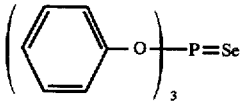
28. 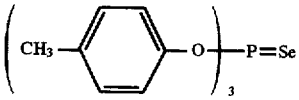
29. $(nC_4H_9O)_3P{=}Se$
30. 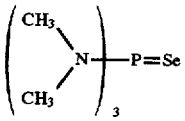
31. 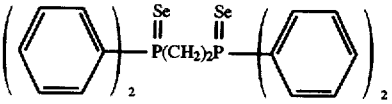
32. $(nC_8H_{17}O)_3P{=}Se$
33. 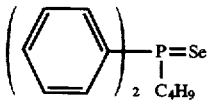
34. 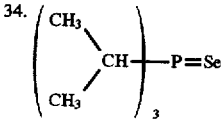
35. 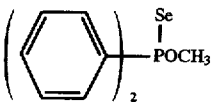
36. 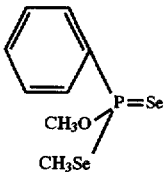
37. 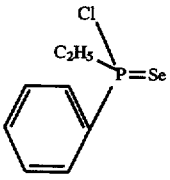
38. 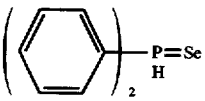
38. $(CH_3)_2P{=}Se$ $CH_3S$
39. 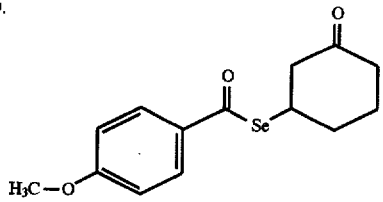

-continued

40.

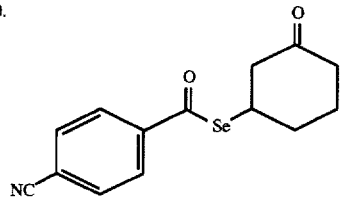

41.

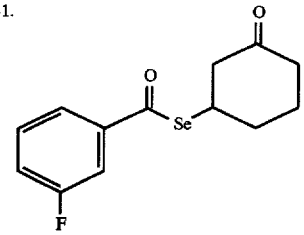

42.

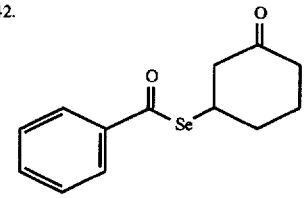

43.

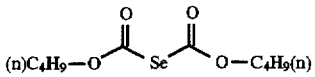

44.

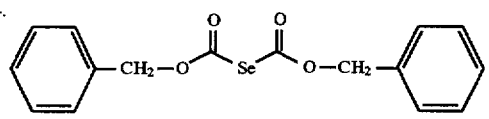

These selenium sensitizers are dissolved in water or a single solution or a mixed solution of an organic solvent such as methanol and ethanol or in the form as disclosed in JP-A-4-140738 and JP-A-4-140739 and added at chemical sensitization. They are preferably added before starting chemical sensitization. The selenium sensitizer used is not limited to one kind and two or more of the above selenium sensitizers can be used in combination. An unstable type selenium compound and a non-unstable type selenium compound can be used in combination.

The addition amount of the selenium sensitizer for use in the present invention is varied according to various conditions such as the activity of the selenium sensitizer used, the kind and size of silver halide grains, and the temperature and time of ripening, but is preferably $1\times10^{-8}$ mol or more, more preferably from $1\times10^{-7}$ mol to $1\times10^{-5}$ mol, per mol of the silver halide. The temperature of chemical ripening when a selenium sensitizer is used is preferably 45° C. or more, more preferably from 50° C. to 80° C. pAg and pH are arbitrary. For example, the effect of the present invention can be obtained at a wide pH range of from 4 to 9.

Selenium sensitization is more effectively conducted in the presence of a solvent for silver halide.

Silver halide solvents which can be used in the present invention include (a) the organic thioethers disclosed in U.S. Pat. Nos. 3,271,157, 3,531,289, 3,574,628, JP-A-54-1019 and JP-A-54-158917, (b) the thiourea derivatives disclosed in JP-A-53-82408, JP-A-55-77737 and JP-A-55-2982, (c) the silver halide solvents having the thiocarbonyl group between an oxygen or sulfur atom and a nitrogen atom disclosed in JP-A-53-144319, (d) the imidazoles disclosed in JP-A-54-100717, (e) sulfite, and (f) thiocyanate.

Particularly preferred are thiocyanate and tetramethylthiourea. The amount of the solvent used is varied depending on the kind of the solvent, for example, thiocyanate is preferably used in an amount of from $1\times10^{-4}$ mol to $1\times10^{-2}$ mol per mol of the silver halide.

The silver halide emulsion of the present invention can achieve higher sensitivity and lower fog by the combined use of sulfur sensitization and/or gold sensitization.

Sulfur sensitization is usually carried out by adding a sulfur sensitizer and stirring the emulsion for a predetermined period of time at high temperature, preferably 40° C. or more.

Gold sensitization is usually carried out by adding a gold sensitizer and stirring the emulsion for a predetermined period of time at high temperature, preferably 40° C. or more.

Known sulfur sensitizers can be used for the above sulfur sensitization, for example, thiosulfate, thioureas, allyl isothiacyanate, cystine, p-toluenethiosulfonate, and rhodanine. In addition to the above, the sulfur sensitizers disclosed in U.S. Pat. Nos. 1,574,944, 2,410,689, 2,278,947, 2,728,668, 3,501,313, 3,656,955, German Patent 1,422,869, JP-B-56-24937 and JP-A-55-45016 can also be used. The addition amount of sulfur sensitizers may be sufficient to effectively increase the sensitivity of the emulsion. The addition amount varies in a considerable wide range according to various conditions such as the pH, temperature and size of silver halide grain but is preferably from $1\times10^{-7}$ mol to $5\times10^{-4}$ mol per mol of the silver halide.

The oxidation number of the gold in the gold sensitizer of the above-described gold sensitization may be either +1 valent or +3 valent, and gold compounds which are usually used as gold sensitizers can be used. Representative examples thereof include chloroaurate, potassium chloroaurate, auric trichloride, potassium auric thiocyanate, potassium iodoaurate, tetracyanoauric acid, ammonium aurothiocyanate, and pyridyl trichiorogold.

The addition amount of the gold sensitizers varies according to various conditions but is preferably from $1\times10^{-7}$ to $5\times10^{-4}$ mol per mol of the silver halide as a criterion.

In a chemical ripening, no limit is required to put on the addition time and the addition order of the sulfur sensitizer and/or the gold sensitizer which can be used in combination with the silver halide solvent and the selenium sensitizer or with the selenium sensitizer, and the above compounds can be added at the same time or at a different addition time, for example, at an initial stage of the chemical ripening (preferably) or during the chemical ripening. The above compounds may be added by dissolving in water or a single solution or a mixed solution of an organic solvent which is miscible with water, for example, methanol, ethanol and acetone.

In the combined use of the selenium sensitizer and the sulfur sensitizer, the addition amount is preferably from 1/9 to 9/1, particularly preferably from 5/5 to 7/3, in a mol ratio of one equivalent of the selenium and the sulfur.

The compounds represented by formula (I') which are preferably used in the present invention as a developing agent are described in detail below.

In formula (I'), R1 and R2 each preferably represents a hydroxyl group, a substituted or unsubstituted amino group (including an amino group having, as a substituent, an alkyl group having from 1 to 10 carbon atoms, e.g., methyl, ethyl, n-butyl, hydroxyethyl), a mercapto group, or a substituted or unsubstituted alkylthio group (e.g., methylthio, ethylthio). Preferred examples of R1 and R2 are a hydroxyl group, an amino group, an alkylsulfonylamino group and an arylsulfonylamino group.

P and Q each represents a hydroxyl group, a carboxyl group, a substituted or unsubstituted alkoxyl group, a substituted or unsubstituted hydroxyalkyl group, a substituted or unsubstituted carboxyalkyl group, a sulfo group, a substituted or unsubstituted sulfoalkyl group, a substituted or unsubstituted amino group, a substituted or unsubstituted alkyl group, or a substituted or unsubstituted aryl group, or P and Q each represents an atomic group necessary to form a 5- to 8-membered ring by connecting with each other together with two vinyl carbon atoms substituted with R1 and R2 and the carbon atom 'substituted with Y. Specific examples of the ring structures are composed of —O—, —C($R_9$) ($R_{10}$)—, —C($R_{11}$)=, —C(=O)—, —N($R_{12}$)—, —N=, etc., in combination, wherein $R_9$, $R_{10}$, $R_{11}$ and $R_{12}$ each represents a hydrogen atom, an alkyl group having from 1 to 10 carbon atoms which can be substituted (substituents thereof include a hydroxyl group, a carboxyl group, a sulfo group, etc.), a hydroxyl group or a carboxyl group. Further, this 5- to 8-membered ring may be condensed with a saturated or unsaturated ring.

Examples of 5- to 8-membered rings include a dihydrofuranone ring, a dihydropyrroline ring, a pyranone ring, a cyclopentenone ring, a cyclohexenone ring, a pyrrolinone ring, a pyrazolinone ring, a pyridone ring, an azacyclohexenone ring, and a uracil ring, and preferred examples include a dihydrofuranone ring, a cyclopentenone ring, a cyclohexenone ring, a pyrazolinone ring, an azacyclohexenone ring, and a uracil ring.

Y represents =O or =N—R3. R3 represents a hydrogen atom, a hydroxyl group, a substituted or unsubstituted alkyl group (e.g., methyl, ethyl), a substituted or unsubstituted acyl group (e.g., acetyl), a substituted or unsubstituted sulfoalkyl group (e.g., sulfomethyl, sulfoethyl), or a substituted or unsubstituted carboxyalkyl group (e.g., carboxymethyl, carboxyethyl).

Specific examples of the compounds represented by formula (I) according to the present invention are shown below, but the present invention should not be construed as being limited thereto.

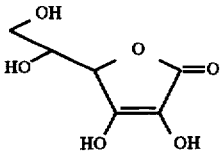

I-1

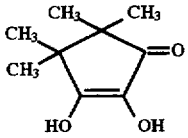

I-2

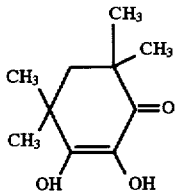

I-3

-continued

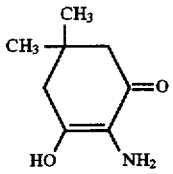

I-4

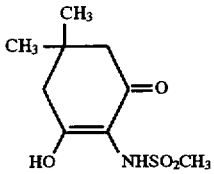

I-5

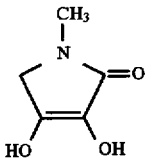

I-6

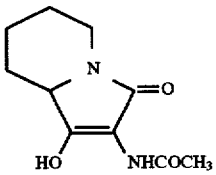

I-7

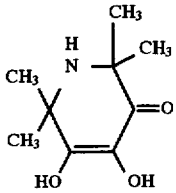

I-8

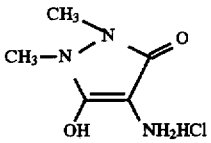

I-9

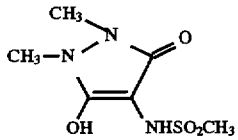

I-10

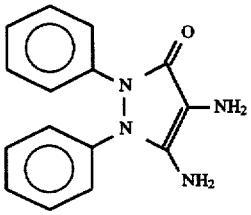

I-11

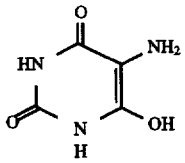

I-12

-continued

Γ-13

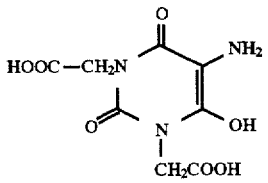

Γ-14

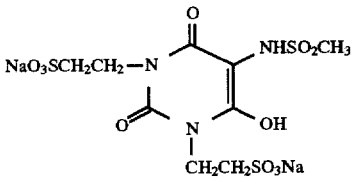

Γ-15

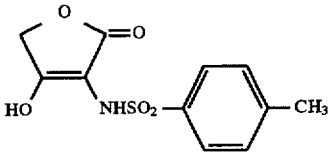

Γ-16

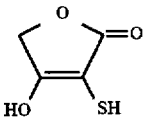

Γ-17

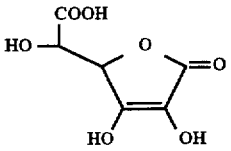

Γ-18

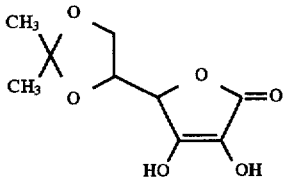

Γ19

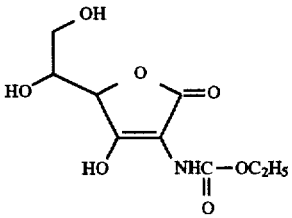

Γ-20

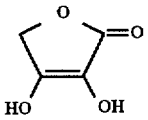

Γ-21

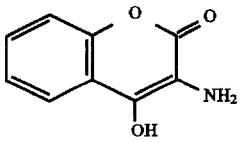

-continued

Γ-22

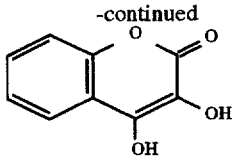

Γ-23

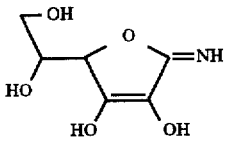

Γ-24

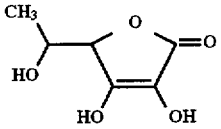

Γ-25

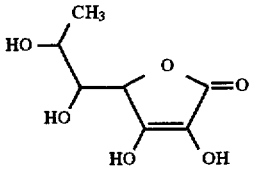

Γ-26

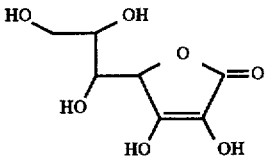

Γ-27

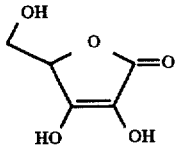

Γ-28

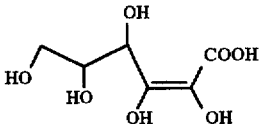

Γ-29

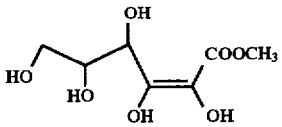

Γ-30

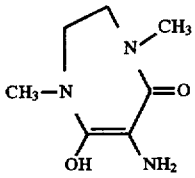

Γ-31

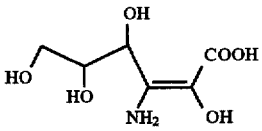

Of these compounds represented by formula (Γ), the ascorbic acid or the erythorvic acid (diastereomer of ascorbic acid) and the alkali metal salt thereof such as a lithium salt, a sodium salt, and a potassium salt are preferred.

The developing agent is generally used in an amount of from 0.01 mol/liter to 0.8 mol/liter, particularly preferably from 0.05 mol/liter to 0.4 mol/liter. In particular, the developing agent represented by formula (I) is preferably used in combination with an auxiliary developing agent exhibiting superadditivity.

Examples of auxiliary developing agents exhibiting superadditivity include 1-phenyl-3-pyrazolidone based auxiliary developing agents and p-aminophenol based auxiliary developing agents.

Examples of 1-phenyl-3-pyrazolidone based auxiliary developing agents include 1-phenyl-3-pyrazolidone, 1-phenyl-4,4-dimethyl-3-pyrazolidone, 1-phenyl-4-methyl-4-hydroxy-methyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, etc. Of these, 1-phenyl-4-methyl-4-hydroxy-methyl-3-pyrazolidone is preferred.

Examples of p-aminophenol based auxiliary developing agents include N-methyl-p-aminophenol, N-(β-hydroxyethyl)-p-aminophenol, N-(4-hydroxyphenyl) glycine, 2-methyl-p-amino-phenol, p-benzylaminophenol, etc., and N-methyl-p-aminophenol is particularly preferred of them.

In the present invention, when the developing agent represented by formula (I) is used in combination with 1-phenyl-3-pyrazolidone based auxiliary developing agent or p-aminophenol based auxiliary developing agent, preferably the former is used in an amount of from 0.01 mol/liter to 0.5 mol/liter and the latter in an amount of from 0.001 mol/liter to 0.1 mol/liter, and particularly preferably the latter is used in an amount of from 0.005 mol/liter to 0.05 mol/liter.

The developing solution for processing the photographic material of the present invention may contain an amino compound as a development accelerator. The amino compounds disclosed in JP-A-56-1106244, JP-A-61-267759 and JP-A-2-208652 can be used for such a purpose.

The pH of the developing solution for processing the photographic material of the present invention is from 8.0 to 13.0, preferably from 8.3 to 12, and more preferably from 8.5 to 10.5.

The developing solution preferably used in the present invention contains carbonate (e.g., sodium carbonate, potassium carbonate) as a pH buffer for setting a pH value. The addition amount of the carbonate is preferably 0.3 mol/liter or more, more preferably 0.4 mol/liter or more, and most preferably from 0.4 mol/liter to 1 mol/liter.

The alkali agents which are used for setting pH of the developing solution for processing the photographic material of the present invention can contain, in addition to the above-described carbonates, ordinarily used water-soluble inorganic alkali metal salts (e.g., sodium hydroxide, potassium hydroxide, etc.) in combination. Specific examples thereof include a pH buffer such as sodium secondary phosphate, potassium secondary phosphate, sodium primary phosphate, and potassium primary phosphate, in addition to these, the pH buffers disclosed in JP-A-60-93433 can be used.

When processing the photographic material of the present invention, the developing solution can contain the compounds disclosed in JP-B-62-4702, JP-B-62-4703, JP-A-1-200249, JP-A-5-303179 and JP-A-5-53257 for the purpose of preventing silver sludge.

The developing solution for processing the photographic material of the present invention may contain a development inhibitor such as potassium bromide and potassium iodide, an organic solvent such as dimethylformamide, methyl cellosolve, ethylene glycol, ethanol, and methanol, and an antifoggant such as 5-methylbenzotriazole, 5-chlorobenzotriazole, 5-bromobenzotriazole, 5-butylbenzotriazole and benzotriazole, as well as the above-described additives such as an amino compound, an alkali agent or a silver sludge inhibitor.

Examples of sulfite preservatives which can be used in the developing solution for use in the present invention include sodium sulfite, potassium sulfite, lithium sulfite, ammonium sulfite, sodium bisulfite, potassium metabisulfite, etc. Preferred addition amount of the sulfite preservative is 0.01 mol/liter or more, particularly preferably from 0.02 mol/liter to 2.5 mol/liter.

In addition to the above, those compounds disclosed in L. F. A. Mason, *Photographic Processing Chemistry*, pp. 226 to 229, The Focal Press (1966), U.S. Pat. Nos. 2,193,015, 2,592,364, and JP-A-48-64933 can be used in the present invention.

Further, a toning agent, a surfactant, a water softener, and a hardening agent may be included, if necessary.

A chelating agent for use in the developing solution of the present invention include, for example, ethylenediamine-di-o-hydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, transcyclohexanediaminetetraacetic acid, ethylenediaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate, and sodium hexametaphosphate, and particularly preferably diethylenetriaminepentaacetic acid, triethylenetetraminehexaacetic acid, 1,3-diaminopropanoltetraacetic acid, glycol ether diaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetrakisphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid and salts of these compounds.

In the processing method according to the present invention, the replenishment rate of the developing solution is from 25 ml to 200 ml, preferably from 30 ml to 180 ml, and still further preferably from 60 ml to 150 ml, per $m^2$ of the photographic material.

In the method of processing the photographic material according to the present invention, the development processing time is preferably from 5 seconds to 30 seconds, most preferably from 5 seconds to 25 seconds.

A non-elusive electrically conductive component (material) preferably used in the present invention is described below.

"Non-elusive" used in the present invention means that when a photographic material is processed with an automatic processor the photographic material is not substantially eluted, specifically the amount eluted is from 0 to 1 wt % based on the addition amount.

Electrically conductive components preferably used in the present invention are crystalline metal oxide grains, and those containing oxygen deficiency, those containing a little amount of different atoms which form a donor against the metal oxide used are preferred as, in general, they have high electric conductivity and, in particular, the latter are preferred as they do not give fog to a silver halide emulsion. Preferred examples of the metal oxides include ZnO, and $TiO_2$, $SnO_2$, $Al_2O_3$, $In_2O_3$, $SiO_2$, MgO, BaO, $MoO_3$ and $V_2O_5$ which are doped with impurities, or composite oxides of them, in particular, ZnO, and $TiO_2$ and $SnO_2$ doped with impurities are preferred. As examples of the metal oxides containing different atoms, for example, addition of Al or In to ZnO, Sb, Nb, P and a halogen element to $SnO_2$, Nb and Ta to $TiO_2$ are effective. The addition amount of these different atoms is preferably from 0.01 mol % to 30 mol %, particularly preferably from 0.1 mol % to 10 mol %. Further, silicone compounds may be added at the time of production of fine grain for improving fine grain dispersing ability and transparency. These metal oxide fine grains which are preferred electrically conductive components in the present invention have electric conductivity and the volume resistivity is $10^7$ Ω/cm or less, particularly $10^5$ Ω/cm or less.

These oxides are disclosed in JP-A-56-143431, JP-A-56-120519 and JP-A-58-62647.

Further, as disclosed in JP-B-59-6235, electrically conductive components prepared by sticking the above metal oxides on other crystalline metal oxide grains or fibrous materials (e.g., titanium oxide) may be used.

The grain size which can be used is preferably 1 μm or less, but when it is 0.5 μm or less, the stability after dispersion is good and easy to use. Further, when electrically conductive grains having a size of 0.3 μm or less are used to reduce light scattering as far as possible, it becomes feasible to prepare a transparent photographic material. There is no lower limit of the grain size but 0.01 μm or more is preferred to obtain excellent electric conductivity.

Further, when the metal oxide fine grain is acicular or fibrous, preferably the length is 30 μm or less and the diameter is 1 μm or less, particularly preferably the length is 10 μm or less and the diameter is 0.3 μm or less, and the length/diameter ratio is 3 or more.

These metal oxides preferably used in the present invention having electric conductivity may be coated without a binder, and in such a case it is preferred to further coat a binder thereon.

The metal oxide preferably used in the present invention is more preferably coated with a binder. The binder is not particularly limited, for example, water-soluble binders such as gelatin, dextran, polyacrylamide, starch, and polyvinyl alcohol may be used, or synthetic polymer binders such as poly(meth)acrylate, polyvinyl acetate, polyurethane, polyvinyl chloride, polyvinylidene chloride, styrene/butadiene copolymer, polystyrene, polyester, polyethylene, polyethylene oxide, polypropylene, and polycarbonate may be used in an organic solvent, further, these polymer binders may be used in the form of dispersion in water.

Spherical and fibrous metal oxides may be used in admixture.

The addition amount of the metal oxide preferably used in the present invention is preferably from 0.0005 to 1.0 g/m$^2$, more preferably from 0.0010 to 0.5 g/m$^2$, and particularly preferably from 0.0050 to 0.3 g/m$^2$.

A heat resisting agent, a weather resisting agent, an inorganic particle, a water-soluble resin, and an emulsion may be added to the layer comprising metal oxide preferably used in the present invention for the purpose of matting and film quality improvement within the range not hindering the effect of the present invention.

For example, inorganic fine particles may be added to the layer comprising metal oxide preferably used in the present invention. Examples of inorganic fine particles to be added are silica, colloidal silica, alumina, alumina sol, caolin, talc, mica, and calcium carbonate. The average particle size of the fine grains is preferably from 0.01 to 10 μm, more preferably from 0.01 to 5 μm, and the amount is preferably from 0.05 to 10%, particularly preferably from 0.1 to 5% in weight ratio to the solid part in the coating solution.

Moreover, various organic or inorganic hardening agents may be added to the coating solution of the present invention. These hardening agents may be low molecular weight compounds or high molecular compounds, and they may be used alone or in combination.

The low molecular weight hardening agents disclosed, for example, in T. H. James, *The Theory of the Photographic Process*, 4th Ed., pp. 77 to 88 are used in the present invention and, above all, those having vinylsulfonic acid, an aziridine group, an epoxy group, a triazine ring are preferred. The low molecular weight compounds disclosed in JP-A-53-41221 and JP-A-60-225143 are particularly preferred. High molecular hardening agents are compounds preferably having at least two or more groups, which react with hydrophilic colloid such as gelatin, in the same molecule and having a molecular weight of 2,000 or more. Groups which react with hydrophilic colloid such as gelatin include, for example, an aldehyde group, an epoxy group, active halide (e.g., dichlorotriazine, chloromethylstyryl, chloroethyl-sulfonyl), an active vinyl group, an active ester, etc.

Examples of high molecular hardening agents for use in the present invention include, for example, dialdehyde starch, polyacrolein, a polymer having an aldehyde group such as the acrolein copolymers disclosed in U.S. Pat. No. 3,396,029, the polymers having epoxy groups disclosed in U.S. Pat. No. 3,623,878, the polymers having dichlorotriazine groups disclosed in *Research Disclosure*, No. 17333 (1978), the polymers having active esters disclosed in JP-A-56-66841, and the polymers having active vinyl groups or precursors thereof disclosed in JP-A-56-142524, U.S. Pat. No. 4,161,407, JP-A-54-5033, *Research Disclosure*, No. 16725 (1978). In particular, those in which an active vinyl group or a precursor thereof is bonded to the principal chain of the polymer via a long spacer as disclosed in JP-A-56-142524 are preferred.

Electrically conductive polymers or latexes which are preferably used in the present invention are described below.

Electrically conductive polymers used are not particularly limited and they may be anionic, cationic, betaine, or nonionic, but anionic and cationic polymers or latexes are preferred. More preferred are anionic sulfonic acid based, carboxylic acid based, and phosphoric acid based polymers or latexes, and tertiary amine based, quaternary ammonium based and phosphonium based polymers or latexes. Examples of these electrically conductive polymers include the anionic polymers and latexes disclosed in JP-B-52-25251, JP-A-51-29923 and JP-B-60-48024 and the cationic polymers and latexes disclosed in JP-B-57-18176, J-B-57-56059, JP-B-58-56856 and U.S. Pat. No. 4,118,231.

Specific examples of these electrically conductive polymers and latexes are shown below, but the present invention is not limited thereto.

P-1

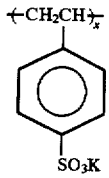

(average molecular weight: 150,000)

P-2

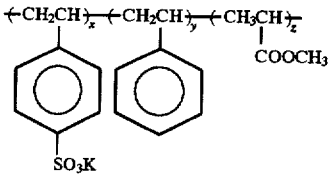

x/y/z = 25/60/15 (latex)

P-3

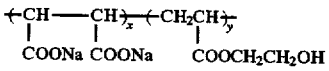

x/y = 70/30
(average molecular weight: 45,000)

P-4

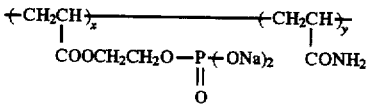

x/y = 50/50
(average molecular weight: 12,000)

P-5

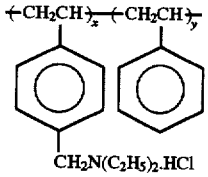

x/y = 30/70 (latex)

P-6

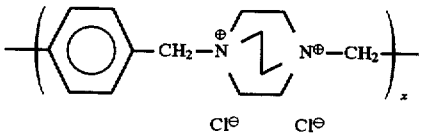

(average molecular weight: 10,000)

P-7

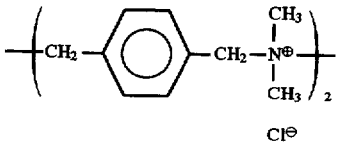

(average molecular weight: 30,000)

Metal oxides are most preferably used in the present invention as electrically conductive components due to its excellent non-elusive ability into processing solutions.

The layers to which the electrically conductive metal oxides, polymers and latexes are preferably added are not particularly limited provided that they are contained in the layers on the same side of the support as the emulsion layers, and there can be cited, for example, a protective layer, an interlayer, an emulsion layer, an UV layer, an antihalation layer, and an undercoat layer. The preferred of these are a protective layer, an interlayer, an antihalation layer, and an undercoat layer, and the particularly preferred are an undercoat layer, an interlayer, and an antihalation layer.

The various additives for use in the photographic material according to the present invention are not particularly limited and, for example, those disclosed in the following corresponding places can be used.

| | |
|---|---|
| 1) Silver halide emulsion and the preparation method | from 6 lines up from the bottom, right lower column, page 8 to line 12, right upper column, page 10 of JP-A-2-68539<br>front line 10, right lower column, page 2 to line 1, right upper column, page 6 of JP-A-3-24537;<br>from line 16, left upper column, page 10 to line 19, left lower column, page 11 of JP-A-3-24537; and JP-A-4-107442 |
| 2) Chemical sensitization method | from line 13, right upper column, page 10 to line 16, left upper column, page 10 of JP-A-2-68539; and JP-A-5-313282. |
| 3) Antifoggant and stabilizer | from line 17, left lower column, page 10 to line 7, left upper column, page 11 of JP-A-2-68539; and<br>from line 2, left lower column, page 3 to left lower column, page 4 of JP-A-2-68539. |
| 4) Tone improving agent | line 7, left lower column, page 2 to line 20, left lower column, page 10 of JP-A-62-276539; and<br>line 15, left lower column, page 6 to line 19, right upper column, page 11 of JP-A-3-94249. |
| 5) Spectral Sensitizing dye | from line 4, right lower column, page 4 to right lower column, page 8 of JP-A-2-68539 |
| 6) Surfactant and antistatic agent | from line 14, left upper column, page 11 to line 9, left upper column, page 12 of JP-A-2-68539. |
| 7) Matting agent, sliding agent and plasticizer | line 10, left upper column, page 12 to line 10, right upper column, page 12 of JP-A-2-68539; and<br>line 10, left lower column, page 14 to line 1, right lower column, page 14 of JP-A-2-68539. |
| 8) Hydrophilic colloid | from line 11, right upper column, page 12 to line 16, left lower column, page 12 of JP-A-2-68539. |
| 9) Hardening agent | from line 17, left lower column, page 12 to line 6, right upper column, page 13 of JP-A-2-68539. |
| 10) Support | from lines 7 to 20, right upper column, page 13 of JP-A-2-68539. |
| 11) Crossover cut method | from line 20, right upper column, page A to right upper column, page 14 of JP-A-2-264944. |
| 12) Dye and mordant | line 1, left lower column, page 13 to line 9, left lower column, page 14 of JP-A-2-68539; and<br>from left lower column, page 14 to right lower column, page 16 of JP-A-3-24537. |
| 13) Polyhydroxybenzenes | from left upper column, page 11 to left lower column, page 12 of JP-A-3-39948; and<br>EP-A-452772. |
| 14) Layer constitution | JP-A-3-198041. |
| 15) Development processing method | from line 7, right upper column, page 16 to line 15, left lower column, page 19 of JP-A-2-103037; and<br>from line 5, right lower column, page 3 to line 10, right upper column, page 6 of JP-A-2-115837. |

The present invention is described in detail below with reference to the specific examples, but the present invention should not be construed as being limited thereto.

EXAMPLE 1

Preparation of Emulsion T1

5.0 g of ammonium nitrate, 6.9 g of potassium bromide and 3.5 g of low molecular weight gelatin having an average molecular weight of 15,000 were added to 1 liter of water, and 40 ml of an aqueous solution of silver nitrate (silver nitrate: 4.0 g) and 35 ml of an aqueous solution containing 0.85 g of potassium bromide were added by a double jet method, with stirring, to the vessel maintained at 50° C. over 40 seconds.

Subsequently, 40 ml of an aqueous solution of silver nitrate (silver nitrate: 4.0 g) was added over 10 minutes with increasing the temperature to 60° C., then 1.0 g of potassium bromide and 18.4 g of gelatin were further added thereto.

Subsequently, 15 ml of 1N sodium hydroxide was added to the mixture, and physical ripening was carried out for 20 minutes while maintaining the temperature at 60° C., then 4 ml of a 100% acetic acid solution was added. Then, an aqueous solution containing 162 g of silver nitrate and an aqueous solution of potassium bromide were added by a controlled double jet method over 35 minutes while maintaining pAg at 8.6 by accelerating the feed rate. Subsequently, 35 ml of a solution of 2N potassium thiocyanate was added. After 5 minutes the temperature was lowered to 35° C. The thus obtained silver halide grains were pure silver bromide tabular grains in which the sum of the projected areas of tabular grains having an aspect ratio of from 3 to 15 accounted for 96% of the sum of the projected areas of the entire grains. The grains had an average grain size corresponding to the circle of the projected area of 0.7 μm, an average thickness of 0.12 μm, and a variation coefficient of a diameter of 25%. The average aspect ratio of individual grain was 6.7.

After soluble salts were removed by flocculation, the temperature was again raised to 40° C., and 35 g of gelatin, 0.1 g of phenoxyethanol and 0.4 g of sodium polystyrenesulfonate as a thickener were added, and pH and pAg were adjusted to 6.4 and 8.2, respectively, with sodium hydroxide and an aqueous solution of silver nitrate.

The emulsion obtained was chemical sensitized with stirring while maintaining the temperature at 56° C.

To the emulsion of 1 mol of silver halide, 0.33 g of potassium iodide was added, then 0.2 g of 4-hydroxy-6-methyl-1,3,3a,7-tetraazaindene was added, and then 3.5 mg of sodium ethylthiosulfinate was added.

Further, $1\times10^{-3}$ mol of Compound A-1, $4\times10^{-6}$ mol of Compound A-2 as a supersensitizer were added succeedingly. Further, 4.6 mg of chloroauric acid and 60 mg of potassium thiocyanate were added.

Subsequently, $5\times10^{-6}$ mol of sodium thiosulfate and $6.5\times10^{-6}$ mol of Selenium Compound-I were added. Selenium Compound-I

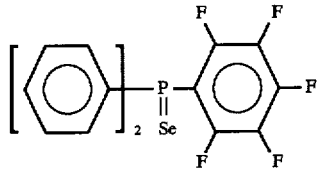

After 20 minutes, $6\times10^{-4}$ mol of sodium sulfite was added, and further after 40 minutes, the temperature was lowered. Thus, the preparation of tabular grain Emulsion T1 was completed.

Preparation of Coating Solution for Emulsion Layer

A coating solution for the emulsion layer was prepared so that the coating weight per one side of the support of each component to be added to Emulsions T1, C1 became as indicated below.

| | |
|---|---|
| 2,6-Bis(hydroxyamino)-4-diethylamino-1,3,5-triazine | 1.7 mg/m² |
| Dextran (average molecular weight: 39,000) | 0.45 g/m² |
| Sodium Polystyrenesulfonate (average molecular weight: 600,000) (including the sodium polystyrene-sulfonate added to the emulsion) | 33 mg/m² |
| Gelatin (including the gelatin added to the emulsion) | 1.1 g/m² |
| Hardening agent 1,2-Bis(vinylsulfonylacetamido)ethane | 55 mg/m² |
| Sodium Hydroquinonemonosulfonate | 0.11 g/m² |
| Dye Emulsified Product b (as dye solid part) | 4.0 mg/m² |
| Dye Emulsified Product m (as dye solid part) | 4.0 mg/m² |
| Infrared Dye Dispersion (as dye solid part) | addition amount is shown in Table 1 |

Compound 1 of the present invention

Dye-b

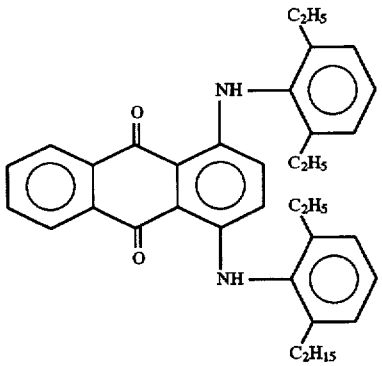

-continued

Dye-m

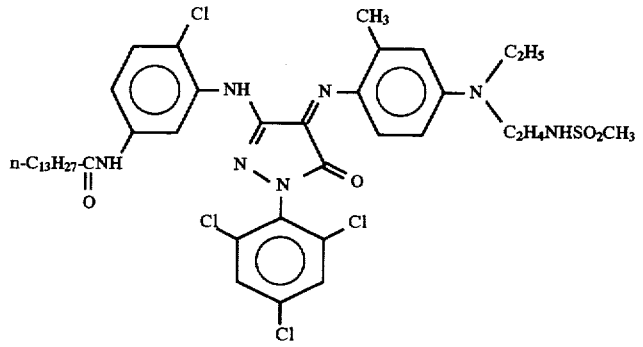

Preparation of Coating Solution for Surface Protective Layer

The surface protective layer was prepared so that the coating weight of each composition became as indicated below.

Gelatin 0.60 g/m$^2$

Benzisothiazolone 1.4 mg/m$^2$

Sodium Polyacrylate (average molecular weight: 41,000) 17 mg/m$^2$

Additive-1 35 mg/m$^2$

Additive-2 5.4 mgg/m$^2$

Additive-3 22.5 mg/m$^2$

Additive-4 0.5 mg/m$^2$

Matting Agent-1 (average particle size: 3.7 μm) 72.5 mg/m$^2$ (or Matting Agent-2, either of the two, described in Table 1)

Additive-1

$C_{18}H_{33}O(CH_2CH_2O)_{10}H$

Additive-2

$C_8F_{17}SO_3K$

Additive-3

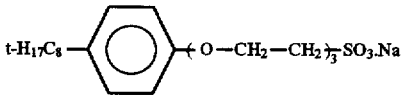

Additive-4

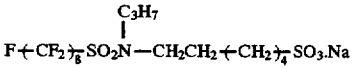

Matting Agent-1

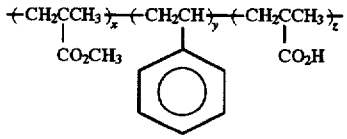

[x/y/z = 76.3/17.5/6.2]

Matting Agent-2

Polymethyl Methacrylate

Preparation of Coating Solution for Interlayer

| | |
|---|---|
| Gelatin | 0.50 g/m$^2$ |
| Benzisothiazolone | 1.4 mg/m$^2$ |
| Sodium Polyacrylate (average molecular weight: 41,000) | 17 mg/m$^2$ |
| Mercapto Compound of the present invention | |
| Compound (12) | addition amount is shown in Table 1 |
| Compound (17) | addition amount is shown in Table 1 |
| Infrared Dye Dispersion (as dye solid part) | addition amount is shown in Table 1 |
| Compound 1 of the present invention | |

Preparation of Photographic Material

The above prepared emulsion and the coating solutions for surface protective layer and interlayer were coated by a double extrusion method on both sides of a PET support of 175 μm provided with an undercoat layer at the same time under the same condition. The amounts of chemicals for each emulsion were changed every coating solution so that the coating amounts of gelatin and the chemicals for each emulsion layer became constant.

The coating weight of silver of each photographic material was set to become the amount shown in Table 1 (g/m$^2$). The interlayer was provided between the surface protective layer and the emulsion layer.

TABLE 1

| Photographic Material | Silver Coating Amount of Emulsion Layer (g/m²) | Infrared Dye Dispersion 1 Surface Protective Layer (mg/m²) | Infrared Dye Dispersion 1 Inter-layer (mg/m²) | Infrared Dye Dispersion 1 Emulsion Layer (mg/m²) | Mercapto Compound in Interlayer Compound (12) (mg/m²) | Mercapto Compound in Interlayer Compound (17) (mg/m²) | Matting Agent in Surface Protective Layer |
|---|---|---|---|---|---|---|---|
| Comparison 1 | 1.7 | 20 | None | None | None | None | 1 |
| Comparison 2 | 1.4 | 20 | None | None | 3 | 3 | 1 |
| Comparison 3 | 1.4 | None | None | None | None | None | 1 |
| Comparison 4 | 1.4 | None | None | 20 | 3 | 3 | 1 |
| Comparison 5 | 1.4 | None | 20 | None | None | None | 1 |
| Invention 6 | 1.4 | None | 20 | None | None | 6 | 1 |
| Invention 7 | 1.4 | None | 20 | None | 3 | 3 | 1 |
| Invention 8 | 1.4 | None | 20 | None | 3 | 3 | 2 |
| Invention 9 | 1.2 | None | 20 | None | 3 | 3 | 1 |

Each coating amount is the amount per one side.

The ratio of swelling of the obtained photographic material measured according to the method disclosed in JP-A-58-111933 was 180%.

Preparation of Concentrated Developing Solution

Concentrated developing solution A having the formulation shown below using sodium erythorvate as a developing agent was prepared.

| | |
|---|---|
| Diethylenetriaminepentaacetic Acid | 8.0 g |
| Sodium Sulfite | 20.0 g |
| Sodium Carbonate Monohydrate | 52.0 g |
| Potassium Carbonate | 55.0 g |
| Sodium Erythorvate | 60.0 g |
| 4-Hydroxymethyl-4-methyl-1-phenyl-3-pyrazolidone | 13.2 g |
| 3,3'-Diphenyl-3,3'-dithiopropionic Acid | 1.44 g |
| Diethylene Glycol | 50.0 g |
| Water to make | 1 liter |
| pH was adjusted with sodium hydroxide | 10.1 |

Preparation of Developing Replenisher

The above concentrated developing solution was diluted to two-fold and this was used as a developing replenisher.

Preparation of Developing Mother Solution

Two liters of the above concentrated developing solution was diluted with water to make 4 liters, and the starter having the following composition was added to the diluted developing solution in an amount of 55 ml per liter of the diluted developing solution. Thus, the developing mother solution having pH of 9.5 was prepared.

Starter

| | |
|---|---|
| Potassium Bromide | 11.1 g |
| Acetic Acid | 10.8 g |
| Water to make | 55 ml |

Preparation of Concentrated Fixing Solution

Concentrated fixing solution having the formulation shown below was prepared.

| | |
|---|---|
| Water | 0.5 liters |
| Ethylenediaminetetraacetic Acid Dihydrate | 0.05 g |
| Sodium Thiosulfate | 200 g |
| Sodium Bisulfite | 98.0 g |
| Sodium Hydroxide | 2.9 g |

-continued

| | |
|---|---|
| Water to make | 1 liter |
| pH was adjusted with NaOH | 5.2 |

Preparation of Fixing Replenisher

The above concentrated fixing solution was diluted to two-fold and this was used as a fixing replenisher.

Preparation of Fixing Mother Solution Two liters of the above concentrated fixing solution was diluted with water to make 4 liters. The pH was 5.4.

Processing of Photographic Material

Photographic materials were processed with an automatic processor FPM-800, a product of Fuji Photo Film Co., Ltd., which was modified so that the opening ratio was 0.02 and also the driving system was modified, using the above developing mother solution and the fixing mother solution. The developing solution and the fixing solution were fed with replenishers for developing solution and fixing solution at the replenishment rate of 103 ml/m² of the photographic material.

| Step | Processing Temperature (°C.) | Processing Time (sec) |
|---|---|---|
| Development | 35 | 25 |
| Fixing | 35 | 25 |
| Washing | 25 | 22 |
| Drying | 55 | 40 |

Evaluation of Fixing Ability

Photographic Materials 1 to 9 of a quarter size were processed without exposure using the above processing solutions with the above processor. Films after processing were visually observed whether fixation could be done. The results obtained are summarized in Table 2.

Evaluation of Light Safety of Safelight

The degree of the increment of photographic density due to explosive light to safelight was compared using safelight filter No. 8 U commercially available from Fuji Photo Film Co., Ltd. Photographic Material 3 which did not contain infrared dye dispersion 1 was taken as a control. Light safety of safelight was evaluated by the ratio of the blackening increasing values on the condition of the increment of blackening of Photographic Material 3 by density of 0.2 when the above processing was carried out after the explosion of light.

Accordingly, the larger the value, the worse is the light safety of safelight.

Evaluation of Detectability Infrared Sensor

Transporting test was carried out using Photographic Materials 1 to 9 with an X-ray television ZS-15, a product of Shimadzu Seisakusho Co. "Good" or "Bad" of detectability was judged from the existence of transporting failure. The results obtained are shown in Table 2.

Evaluation of Transfer of Infrared Dye

Photographic Materials 1 to 9 were rubbed with a white cotton glove. Transfer of the infrared dye to the white glove was observed with Photographic Material 2, therefore, it was impracticable.

TABLE 2

| Photographic Material | Fixing Ability | Light Safety of Safelight | Detectability with Infrared Sensor | Transfer of Infrared Dye |
|---|---|---|---|---|
| Comparison 1 | Bad | 6.0 | Good | Transferred Bad |
| Comparison 2 | Good | 1.2 | Good | Transferred Bad |
| Comparison 3 | Good | 1.0 (control) | Bad | Good |
| Comparison 4 | Good | 5.3 | Good | Good |
| Comparison 5 | Good | 3.1 | Good | Good |
| Invention 6 | Good | 1.1 | Good | Good |
| Invention 7 | Good | 1.2 | Good | Good |
| Invention 8 | Good | 1.2 | Good | Good |
| Invention 9 | Good | 1.2 | Good | Good |

EXAMPLE 2

Evaluation of Contamination of Processing Solution

Using the above processing solutions and processor, 1,000 sheets of Photographic Materials 7 and 8 of a quarter size were processed at a blackening ratio of developed silver of 40%, then the turbidity of the developing solution and the fixing solution was evaluated visually. As a result, the present invention using Matting Agent-1 was superior to the present invention using Matting Agent-2 in the transparency of processing solutions and a deposit in the bottom of the tank of the processor.

Photographic Material 1 in which the coating amount of silver was beyond the limit of the present invention and the mercapto compound according to the present invention was not contained was inferior in fixing ability and safelight safety and absolutely impracticable. Moreover, dye transfer was generated because the dye was contained in the surface protective layer.

Comparing Photographic Materials 2 to 9, Photographic Material 2 which contained the dye dispersion in the surface protective layer was bad in transferring ability of the infrared dye and impracticable. Photographic Material 3 which did not contain the infrared dye caused detection failure with an infrared sensor. Photographic Material 4 which contained the infrared dye in the emulsion layer was extremely degraded in light safety of the safelight in spite of containing the mercapto compounds of the present invention.

Photographic Material 5 was insufficient in light safety of safelight, because the infrared dye dispersion was contained in the interlayer but the mercapto compound of the present invention was not contained.

On the contrary, by Photographic Materials 6 to 9, which satisfied the constitution of the present invention, all the problems were resolved and the objects of the present invention were attained. From the above, the effect of the present invention is apparent.

According to the present invention, when the photographic material of a reduced silver coated amount was processed with the automatic processor at a reduced replenishing rate, detectability of a detective sensor is excellent, safelight safety is excellent and, further, the contamination due to transfer of a dye can be improved.

EXAMPLE 3

Preparation of Emulsion T1'

5.0 g of ammonium nitrate, 6.9 g of potassium bromide and 3.5 g of low molecular weight gelatin having an average molecular weight of 15,000 were added to 1 liter of water, and 40 ml of an aqueous solution of silver nitrate (silver nitrate: 4.0 g) and 35 ml of an aqueous solution containing 0.85 g of potassium bromide were added by a double jet method, with stirring, to the vessel maintained at 50° C. over 40 seconds.

Subsequently, 40 ml of an aqueous solution of silver nitrate (silver nitrate: 4.0 g) was added over 10 minutes with increasing the temperature to 60° C., then 1.0 g of potassium bromide and 18.4 g of gelatin were further added thereto.

Subsequently, 15 ml of 1N sodium hydroxide was added to the mixture, and physical ripening was carried out for 20 minutes while maintaining the temperature at 60° C., then 4 ml of a 100% acetic acid solution was added. Then, an aqueous solution containing 162 g of silver nitrate and an aqueous solution of potassium bromide were added by a controlled double jet method over 35 minutes while maintaining pAg at 8.6 by accelerating the feed rate. Subsequently, 35 ml of a solution of 2N potassium thiocyanate was added. After 5 minutes the temperature was lowered to 35° C. The thus obtained silver halide grains were pure silver bromide tabular grains in which the sum of the projected areas of tabular grains having an aspect ratio of from 3 to 30 accounted for 96% of the sum of the projected areas of the entire grains. The grains had an average grain size corresponding to the circle of the projected area of 0.7 μm, an average thickness of 0.12 μm, and a variation coefficient of a diameter of 25%. The average aspect ratio of individual grain was 6.7.

After soluble salts were removed by flocculation, the temperature was again raised to 40° C., and 35 g of gelatin, 0.1 g of phenoxyethanol and 0.4 g of sodium polystyrenesulfonate as a thickener were added, and pH and pAg were adjusted to 6.4 and 8.2, respectively, with sodium hydroxide and an aqueous solution of silver nitrate.

The emulsion obtained was chemically sensitized with stirring while maintaining the temperature at 56° C.

To the emulsion of 1 mol of silver halide, 0.33 g of potassium iodide was added, then 0.2 g of 4-hydroxy-6-methyl-1,3,3a,7-tetraazaindene was added, and then 3.5 mg of sodium ethylthiosulfinate was added.

Further, $1\times10^{-3}$ mol of Compound A-1, $4\times10^{-6}$ mol of Compound A-2 as a supersensitizer were added succeedingly. Further, 4.6 mg of chloroauric acid and 60 mg of potassium thiocyanate were added. Subsequently, sensitization using chalcogen compounds was conducted in the following two sensitizing methods. (See the column of chalcogen sensitization in Table 3).

Se Type Sensitizing Method $5\times10^{-6}$ mol of sodium thiosulfate and $6.5\times10^{-6}$ mol of Selenium Compound-3 were a S Type Sensitizing Method $15\times10^{-6}$ mol of sodium thiosulfate was added.

In either case, after 20 minutes, $6\times10^{-4}$ mol of sodium sulfite was added, and further after 40 minutes, 20 mg of Compound A-4 was added and the temperature was lowered to 35° C.

Thus, the preparation of tabular grain Emulsion 1' was completed.

Compound A-1

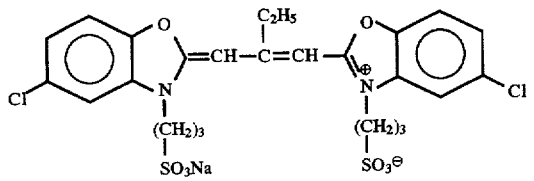

Compound A-2

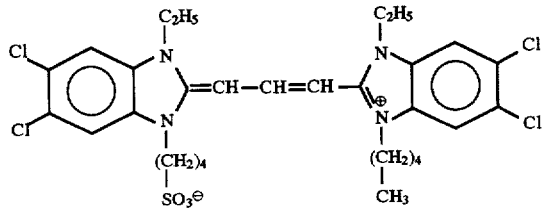

Compound A-3

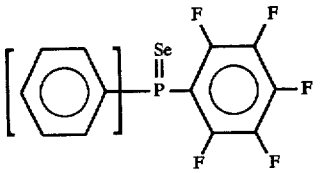

Compound A-4

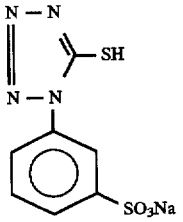

Preparation of Emulsion C1

Pure silver bromide cubic emulsion was prepared by the same amount of silver as Emulsion T1'.

The average grain size corresponding to the circle of the projected area was 0.6 μm and a variation coefficient of a diameter was 20%.

Flocculation and dispersion were conducted in the same manner as T1' and chemical sensitization was also conducted in the same manner as T1'.

Se Type Sensitizing Method

Preparation of Coating Solution for Emulsion Layer

A coating solution for the emulsion layer was prepared so that the coating weight per one side of the support of each component to be added to Emulsions T1' and C1 became as indicated below.

| | |
|---|---|
| 2,6-Bis(hydroxyamino)-4-diethylamino-1,3,5-triazine | 1.7 mg/m$^2$ |
| Dextran | 0.45 g/m$^2$ |
| Sodium Polystyrenesulfonate (average molecular weight: 600,000) (including the sodium polystyrenesulfonate added to the emulsion) | 33 mg/m$^2$ |
| Gelatin (including the gelatin added to the emulsion) | 1.1 g/m$^2$ |
| Hardening Agent 1,2-Bis(vinylsulfonylacetamido)ethane | |
| (when ratio of swelling in Table 3 was 250%) | 35 mg/m$^2$ |
| (when ratio of swelling in Table 3 was 180%) | 55 mg/m$^2$ |
| (when ratio of swelling in Table 3 was 120%) | 95 mg/m$^2$ |
| Compound A-5 | 0.11 g/m$^2$ |
| Dye Emulsified Product b (as dye solid part) | 4.0 mg/m$^2$ |
| Dye Emulsified Product m (as dye solid part) | 4.0 mg/m$^2$ |

Compound A-5

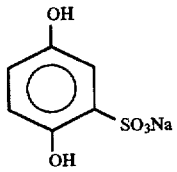

Preparation of Dye Emulsified Product b 60 g of Dye-1 shown below, 62.8 g of 2,4-diamylphenol, 62.8 g of dicyclohexyl phthalate and 333 g of ethyl acetate were dissolved at 60° C. Then, 65 ml of a 5% aqueous solution of sodium dodecylbenzenesulfonate, 94 g of gelatin and 581 ml of water were added thereto, and dispersed in an emulsion condition using a dissolver at 60° C. over 30 minutes. Subsequently, 2 g of methyl p-hydroxybenzoate and 6 liters of water were added to the above dispersion and the temperature was lowered to 40° C. Next, the emulsion was concentrated until the total weight reached 2 kg using ultrafiltration labo module ACP1050, a product of Asahi Chemical Industry Co. Ltd., and 1 g of methyl p-hydroxybenzoate was added thereto. Thus, Dye Emulsified Product b was obtained.

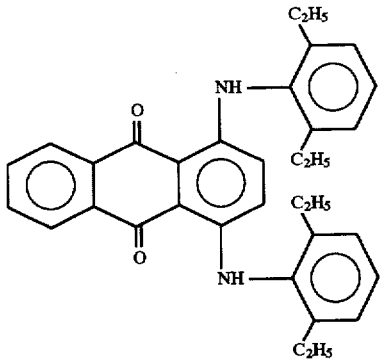

Preparation of Dye Emulsified Product m 10 g of Dye-2 was weighed and dissolved in a solvent comprising 10 ml of tricresyl phosphate and 20 ml of ethyl acetate. This solution was emulsifying dispersed in 100 ml of a 15% aqueous solution of gelatin containing 750 ml of an anionic surfactant. Thus, Dye Emulsified Product m was obtained.

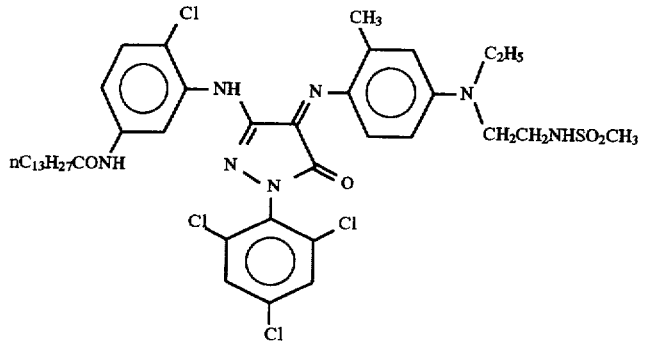

Dye-2

Preparation of Dye Dispersion i

A 5% aqueous solution of carboxymethyl cellulose was added to Dye-3, which was handled as a wet cake so as not to be dried as far as possible, in proportion of 15 g of the solution per 2.5 g of a dry solid part of the dye to make the entire weight 63.3 g, and this was mixed well to obtain a slurry. Next, 100 ml of glass beads having diameters of from 0.8 to 1.2 mm and the slurry were put in a disperser (1/16G sand grinder mill, a product of Imex Co.), and dispersed for 12 hours. Then, water was added to dilute the dispersion to dye concentration of 2 wt %. Thus, Dye Dispersion i was obtained.

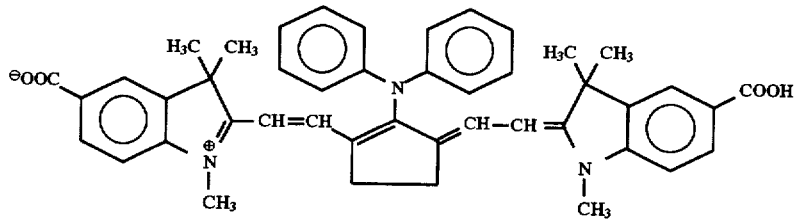

Dye-3

Preparation of Coating Solution for Surface Protective Layer

The surface protective layer was prepared so that the coating weight of each composition became as indicated below.

| | |
|---|---|
| Gelatin | 0.60 g/m² |
| Benzisothiazolone | 1.4 mg/m² |
| Sodium Polyacrylate (average molecular weight: 41,000) | 17 mg/m² |
| Additive-1 | 35 mg/m² |
| Additive-2 | 5.4 mg/m² |
| Additive-3 | 22.5 mg/m² |
| Additive-4 | 0.5 mg/m² |
| Matting Agent-1 (average particle size: 3.7 μm) | 72.5 mg/m² |

Additive-1

$C_{18}H_{33}O(CH_2CH_2O)_{10}H$

Additive-2

$C_8F_{17}SO_3K$

Additive-3

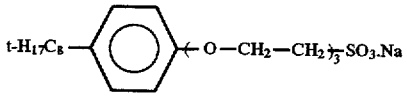

Additive-4

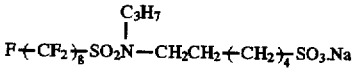

Matting Agent-1

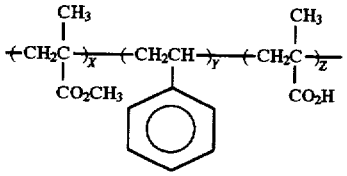

[X/Y/Z = 76.3/17.5/6.2]

Preparation of Coating Solution for Interlayer

| | |
|---|---|
| Gelatin | 0.50 g/m² |
| Benzisothiazolone | 1.4 mg/m² |
| Sodium Polacrylate (average molecular weight: 41,000) | 17 mg/m² |

-continued

| | |
|---|---|
| Compound A-6 | 4.4 mg/m² |
| Compound A-7 | 1.3 mg/m² |
| Compound A-8 | 0.5 mg/m² |
| Dye Dispersion i (as dye solid part) | 18 mg/m² |

Compound A-6

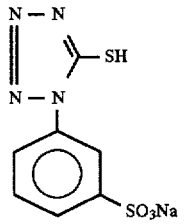

Compound A-7

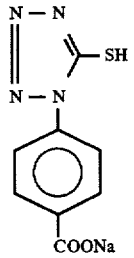

Compound A-8

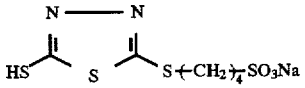

Preparation of Support

A biaxially stretched polyethylene terephthalate film having a thickness of 175 μm was corona discharged, and the first undercoat solution having the following composition was coated by a wire bar coater so that the coating amount reached 4.9 ml/m², and then dried at 185° C. for 1 minute.

Then, the first undercoat layer was also coated on the opposite side similarly. The polyethylene terephthalate used contained 0.04 wt % of Dye-1.

| | |
|---|---|
| Solution of Butadiene-Styrene Copolymer Latex (solid part: 40%, weight ratio of butadiene/styrene = 31/69) | 158 ml |
| A 4% Solution of Sodium 2,4-Dichloro-6-hydroxy-s-triazine | 41 ml |
| Distilled Water | 801 ml |

Compound A-9 was contained in the latex solution as an emulsifying dispersant in an amount of 0.4 wt % per a latex solid part.

Compound A-9

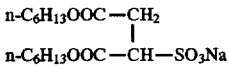

Preparation of Developing Replenisher

Developing replenisher A having the formulation shown below using sodium erythorvate as a developing agent was prepared.

| | |
|---|---|
| Diethylenetriaminepentaacetic Acid | 8.0 g |
| Sodium Sulfite | 19.6 g |
| Sodium Bisulfite | 2.8 g |
| Sodium Carbonate Monohydrate | 52.0 g |
| Potassium Carbonate | 55.0 g |
| Sodium Erythorvate | 60.0 g |
| 4-Hydroxymethyl-4-methyl-1-phenyl-3-pyrazolidone | 13.2 g |
| 3,3'-Diphenyl-3,3'-dithiopropionic Acid | 1.44 g |
| Diethylene Glycol | 50.0 g |
| Water to make | 1 liter |
| pH was adjusted with sodium hydroxide or acetic acid | 10.1 |

Preparation of Developing Mother Solution

Two liters of the above developing replenisher A was diluted with water to make 4 liters, and the starter having the following composition was added to developing replenisher A in an amount of 55 ml per liter of developing replenisher A. Thus, the developing mother solution modified pH to 9.5 was prepared.

Starter

| | |
|---|---|
| Potassium Bromide | 11.1 g |
| Acetic Acid | 10.8 g |
| Water to make | 55 ml |

Preparation of Fixing Replenisher

Fixing replenisher having the formulation shown below was prepared.

| | |
|---|---|
| Water | 0.5 liters |
| Ethylenediaminetetraacetic Acid Dihydrate | 0.05 g |
| Sodium Thiosulfate Pentahydrate | 300 g |
| Sodium Bisulfite | 98.0 g |
| Sodium Hydroxide | 2.91 g |
| Water to make | 1 liter |
| pH was adjusted with NaOH | 5.4 |

Preparation of Fixing Mother Solution

Two liters of the above fixing replenisher was diluted with water to make 4 liters. The pH was 5.6.

Processing Method of Photographic Material

Photographic materials were processed with an automatic processor FPM-1300, a product of Fuji Photo Film Co., Ltd., which was modified so that the opening ratio was 0.02, using the above developing mother solution and the fixing mother solution. The developing mother solution and the fixing mother solution were fed with the developing replenisher and the fixing replenisher at the replenishment rate of 103 ml/m² of the photographic material. The table of items of processing step of dry to dry of 120 seconds is as follows.

| Step | Processing Temperature (°C.) | Processing Time (sec) |
|---|---|---|
| Development | 35 | 25 |
| Fixing | 35 | 25 |
| Washing | 25 | 30 |
| Drying | 55 | 40 |
| Total (dry to dry) | | 120 |

Preparation of Photographic Material

The above prepared emulsion and the coating solutions for surface protective layer and interlayer were coated by a double extrusion method on both sides of the above-described support one after another under the same condition. The amounts of chemicals for each emulsion were changed every coating solution so that the coating amounts of gelatin and the chemicals for each emulsion layer became constant.

The coating weight of silver of each photographic material was set to become the amount shown in Table 3 (g/m$^2$).

Further, the ratio of swelling was measured according to the definition described in the present specification.

TABLE 3

| Photographic Material | Emulsion | Chalcogen Sensitization | Silver Amount | Ratio of Swelling (%) |
|---|---|---|---|---|
| 1 | T1' | S type | 1.8 | 250 |
| 2 | T1' | S type | 1.8 | 180 |
| 3 | T1' | S type | 1.4 | 180 |
| 4 | T1' | Se type | 1.8 | 180 |
| 5 | T1' | Se type | 1.4 | 250 |
| 6 | T1' | Se type | 1.4 | 180 |
| 7 | T1' | Se type | 1.4 | 120 |
| 8 | T1' | Se type | 1.2 | 180 |
| 9 | T1' | Se type | 1.0 | 180 |
| 10 | Cl | Se type | 1.8 | 180 |
| 11 | Cl | Se type | 1.4 | 180 |

Evaluation of Photographic Performance 1,000 sheets of Photographic Material 6 of a quarter size were running processed using the above processing solutions and the processor according to the above replenishing method (blackening ratio: 40%).

Each photographic material was subjected to exposure for 0.1 seconds from both sides through X-ray ortho screen HG-M manufactured by Fuji Photo Film Co., Ltd. and processed in two ways of 120 sec. processing (developing time: 25 sec.) and 180 sec. processing (developing time: 38 sec.) and sensitivity was evaluated.

Photographic Material 1 was processed for 120 seconds and the sensitivity obtained was taken as 100. Photographic sensitivity of each photographic material was shown in ratio of reciprocal of exposure amount required when developing density reached half of the maximum density which could be obtained in 120 sec. processing or 180 sec. processing with that of Photographic Material 1. The value indicating the sensitivity is preferably larger. The developing density is a value subtracting the fog density of the support and unexposed part. Maximum density is a value subtracting the density of the support. In Table 4, if the developing density was sufficiently saturated in 120 sec. processing at maximum exposure amount given and showed the same maximum density in 180 sec. processing, Dmax is represented by "○", and when not saturated, represented by "x". The sample with the indication of "x" means that the development is not yet completed with that developing time.

Evaluation of Drying Ability

A sample of 35 cm×35 cm (large size) was processed with an automatic processor for 120 seconds and the sample came out of the outlet of drying zone was touched and evaluated.

○: Sufficiently dry x: Humid and problematic

The results obtained are shown in Table 4. Photographic materials of the present invention provided the sensitivity in 120 sec. processing equivalent to 180 sec. processing, and sufficient Dmax which showed development was completed in 120 sec. processing. Sensitivity and stability of gradation were high and drying ability was excellent. When Photographic Materials 1 to 11 were measured the infrared sensor detectability according to the method of Example 1, the results were all "Good".

TABLE 4

| Photographic | 120 Second Processing | | 180 Second Processing | | Drying Ability (120 second |
|---|---|---|---|---|---|
| Material | Sensitivity | Dmax | Sensitivity | Dmax | processing) |
| 1 | 100 | x | 120 | 4.1 | x |
| 2 | 70 | x | 95 | 4.0 | ○ |
| 3 | 70 | x | 100 | 3.1 | ○ |
| 4 | 100 | x | 150 | 4.0 | ○ |
| 5 | 150 | ○ | 160 | 3.2 | x |
| 6 | 150 | ○ | 160 | 3.1 | ○ |
| 7 | 120 | x | 140 | 3.0 | ○ |
| 8 | 155 | ○ | 160 | 2.6 | ○ |
| 9 | 160 | ○ | 160 | 2.2 | ○ |
| 10 | 90 | x | 140 | 2.9 | ○ |
| 11 | 125 | ○ | 155 | 2.2 | ○ |

EXAMPLE 4

In the preparation of Emulsion T1' in Example 3, the amount of low molecular weight gelatin was changed to 5.0 g and an emulsion was prepared. The obtained emulsion was designated T2.

The thus obtained silver halide grains were pure silver bromide tabular grains in which the tabular grains having an aspect ratio of from 3 to 30 accounted for 97% of the projected area. The grains had an average grain size corresponding to the circle of the projected area of 1.0 μm, and a variation coefficient of a diameter of 30%. The average thickness was 0.16 μm.

Flocculation and dispersion were conducted in the same manner as T1'. Chemical sensitization was conducted in Se type sensitization of T1' and the amount added of each chemical was half in the case of T1'.

Coating was carried out in the same manner as Materials 4 and 6 in Example 1 using Emulsion T2 and the obtained photographic materials were designated Materials 12 and 13. (Refer to Table 5)

The ratio of swelling of Materials 12 and 13 was 180%, which was the same with Materials 4 and 6.

Processing method and evaluation of photographic performances were the same as in Example 3.

The results obtained are shown in Table 5.

Photographic Material 13 using T2 the grain size of which was larger than that of T1' and average grain size corresponding to the circle of the projected area was 1.0 μm provided high sensitivity in 180 sec. processing but the sensitivity in 120 sec. processing was about the same as Material 6. Material 6 is superior to Material 13 in the point of giving high maximum density. When Photographic Materials 12 and 13 were measured the infrared sensor detectability according to the method of Example 1, the results were all "Good" like Photographic Materials 4 and 6.

TABLE 5

| Photographic | | Silver | 120 Sec. Processing | | 180 Sec. Processing | |
|---|---|---|---|---|---|---|
| Material | Emulsion | Amount | Sensitivity | Dmax | Sensitivity | Dmax |
| 4 | T1' | 1.8 | 100 | x | 150 | 4.0 |
| 6 | T1' | 1.4 | 150 | ○ | 160 | 3.1 |

TABLE 5-continued

| Photo-graphic Material | Emulsion | Silver Amount | 120 Sec. Processing Sensitivity | 120 Sec. Processing Dmax | 180 Sec. Processing Sensitivity | 180 Sec. Processing Dmax |
|---|---|---|---|---|---|---|
| 12 | T2 | 1.8 | 140 | x | 250 | 3.2 |
| 13 | T2 | 1.4 | 145 | ○ | 250 | 2.5 |

EXAMPLE 5

Preparation of Support Provided with Electrically Conductive Layer

The electrically conductive layer having the following composition was coated on both sides one after another as the second undercoat layer of the support in Example 3 by a wire bar coater and dried to obtain a support.

| | |
|---|---|
| Gelatin | 19 mg/m$^2$ |
| $SnO_2$/Sb (9/1 by weight ratio, average grain size: 0.24 μm) | 160 mg/m$^2$ |

Preparation of Photographic Material

On both sides of the above prepared support, the emulsion layer, interlayer and surface protective layer having the same formulation as the coated sample 6 in Example 3 were coated in the same manner as in Example 3. This sample was designated Coated Sample 14.

Coated Sample 15 was prepared by excluding Additive 1 from the surface protective layer of Coated Sample 14.

Measurement of Surface Resistivity

Samples 6, 14 and 15 were each aged under 25° C., 10% RH for 6 hours and surface resistivity (logSR) was measured.

Method and Evaluation of Processing with Rereduced Replenishing Rate 1,000 sheets of PhotOgraphic Materials 6, 14 and 15 of a quarter size which were exposed so that the development rate became 40% were processed using the processing solutions and the processor used in Example 3. Processing was started from the fresh solution with replenishing rate of 5 ml/quarter size. The processing time was 120 seconds.

Evaluation was conducted by comparing development unevenness and the amount of foam of processed films. With respect to development unevenness, processed films of 900th to 1,000th were observed and in the case where extreme generation of development unevenness was observed was ranked as "x", where there were generated a little unevenness but negligible as "Δ" and where there was little unevenness as "○".

With respect to foam, a developing tank in the condition of driving immediately after processing 1,000 sheets of films was observed. The case where foam was attached to the roller was indicated as "yes" in Table 6 and the case where almost no foam was observed as "no".

As is shown in Table 6, Coated Sample 15 having an electrically conductive layer is excellent in electrostatic characteristics even in the processing with extremely low replenishing rate and exhibits preferred characteristics generating no foam and development unevenness.

TABLE 6

| Photographic Material | Electrically Conductive Layer | log (SR) | Foam in Developing Solution | Development Unevenness |
|---|---|---|---|---|
| 4 | Absent | 13.5 | Yes | x |
| 5 | Absent | 13.5 | Yes | x |
| 6 | Absent | 13.5 | Yes | Δ |
| 14 | Present | Measurement was impossible | Yes | Δ |
| 15 | Present | 11.0 | No | ○ |

The ratio of swelling of Coated Samples 14 and 15 was each 175% and were excellent in drying ability the same as Sample 6. Also, in both 120 sec. and 180 sec. processing, they exhibited the same excellent photographic performances of sensitivity and Dmax as Sample 6.

EXAMPLE 6

Preparation of Emulsion A of the Present Invention

Silver chloride tabular grains were prepared as follows.

| | |
|---|---|
| Solution (1) | |
| Inactive Gelatin | 20 g |
| Compound A-10 | 0.8 g |
| NaCl | 4 g |
| $H_2Cl$ | 1,750 ml |
| Solution (2) | |
| $AgNO_3$ | 7.6 g |
| $H_2O$ to make | 30 ml |
| Solution (3) | |
| NaCl | 2.8 g |
| $H_2O$ to make | 30 cc |
| Solution (4) | |
| $AgNO_3$ | 24.5 g |
| $H_2O$ | 96 ml |
| Solution (5) | |
| NaCl | 0.3 g |
| $H_2O$ | 65 ml |

-continued

| | |
|---|---|
| Solution (6) | |
| $AgNO_3$ | 101.9 g |
| $H_2O$ to make | 400 ml |
| Solution (7) | |
| NaCl | 37.6 g |
| $H_2O$ | 400 ml |
| Compound A-10 | |

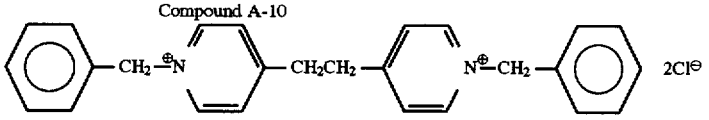

Solution (2) and Solution (3) were added to Solution (1) maintained at 35° C. at the same time with stirring over 1 minute and the temperature of the solution was raised to 50° C. over 15 minutes. At this point, grains corresponding to about 5.7% of the entire silver amount were formed. Next, Solution (4) and Solution (5) were added thereto over 24 minutes, then Solution (6) and Solution (7) were added at the same time over 40 minutes to obtain silver chloride tabular Emulsion A.

After the emulsion was washed and desalted by flocculation, 30 g of gelatin and water were added, further 2.0 g of phenoxyethanol and 0.8 g of sodium polystyrenesulfonate as a thickener were added, and redispersed with sodium hydroxide so as to adjust the pH to 6.0.

The grains obtained were silver chloride tabular grains having {111} faces as a major face and having an average grain size corresponding to the circle of the projected area of 0.68 μm, an average thickness of 0.11 μm, a variation coefficient of a diameter of 19%, and an average aspect ratio of 6.5. The average aspect ratio of individual grain was 6.7.

The sum of the projected areas of the tabular grains having an aspect ratio of from 3 to 30 accounted for 95% of the projected area of the entire grains.

This emulsion was chemically sensitized in the same condition as T1' in Example 3 (Chemical sensitization was conducted in Se type sensitizing method).

Preparation of Emulsion B of the Present Invention 1,200 ml of an aqueous solution of gelatin (containing 18 g of deionized alkali-processed ossein gelatin of a methionine content of about 40 μmol/g, pH: 4.3) were put in a reaction vessel, while maintaining the temperature at 35° C., 12 ml of Ag-1 solution (containing 20 g of $AgNO_3$, 0.8 g of the above gelatin and 0.2 ml of $HNO_3$ 1N solution in 100 ml of Ag-1 solution) and 12 ml of X-1 solution (containing 6.9 g of NaCl, 0.8 g of the above gelatin, and 0.3 ml of NaOH 1N solution in 100 ml of X-1 solution) were simultaneously added to the vessel and mixed at a rate of 24 ml/min. After stirring for 2 minutes, 19 ml of Ag-2 solution (containing 2 g of $AgNO_3$, 0.8 g of the above gelatin and 0.2 ml of $HNO_3$ 1 N solution in 100 ml of Ag-2 solution) and 19 ml of X-2 solution (containing 1.4 g of KBr, 0.8 g of the above gelatin and 0.2 ml of NaOH 1N solution in 100 ml of X-2 solution) were simultaneously added thereto and mixed at a rate of 31 ml/min. 20 ml of NaCl-1 solution (containing 10 g of NaCl in 100 ml of NaCl solution) was added to the reaction mixture, pH was adjusted to 4.8 and the temperature was raised to 60° C. After ripening was carried out for 20 minutes, the temperature was lowered to 60° C. and pH was adjusted to 5.0. Ag-3 solution (containing 10 g of $AgNO_3$ in 100 ml of Ag-3 solution) and X-3 solution (containing 3.6 g of NaCl in 100 ml of X-3 solution) were added by a controlled double jet method at 130 mV of silver potential. The feed rate at starting time of the addition was 7 ml/min and the feed rate was accelerated at a rate of 0.1 ml per minute and 400 ml of Ag-3 solution was added.

Then, a precipitant was added, the temperature was reduced to 30° C., the precipitate was washed with water, aqueous solution of gelatin was added, pH was adjusted to 6.2 at 38° C. and pCl was adjusted to 3.0 at 38° C. A part of the emulsion was taken out and transmission electron microscope image (hereinafter, TEM) of the replica of the grains were observed. The grains were tabular grains having {100} as a major plane. The shape characteristic values of the grains were:

(entire projected area of {100} tabular grains having aspect ratio of from 3 to 30/sum of projected area of all AgX grains)=0.94

(average aspect ratio (average diameter/average thickness) of {100} tabular grains having aspect ratio of 2 or more)=8.2 average grain size of grains corresponding to a circle of the projected area =0.71 μm (entire projected area of twin grains/entire projected area of {100} tabular grains having aspect ratio of 2 or more)=0

(sum of the entire projected area of {100} tabular grains having aspect ratio of 2 or more and edge ratio of 1 to 1.4/sum of the projected area of the entire AgX grains) =0.86

(when {100} tabular grains having aspect ratio of 2 or more was taken out by 70% of the entire projected area from the order of larger one, a variation coefficient of a diameter distribution)=0.59, average thickness =0.10 μm.

Flocculation method, dispersion method and chemical sensitization of this silver halide emulsion was conducted in the same condition as Emulsion A.

Preparation of Coated Sample

Emulsions A and B above were coated on both sides of the support in the same formulation as Sample 15 in Example 5. Sample coated with Emulsion A was designated Sample 16 and sample coated with Emulsion B was designated Sample 17.

The coating amount of silver per one side was 1.4 g/m$^2$, the ratio of swelling was 175% with both of Samples 16 and 17.

Samples 16 and 17 of the present invention, same as Sample 16 in Example 1, were excellent in drying ability in both 120 sec. and 180 sec. processing, and sensitivity and Dmax in 120 sec. processing were also excellent. When Photographic Materials 16 and 17 were measured the infrared sensor detectability according to the method of Example 1, the results were all "Good".

Accordingly, the present invention can provide a photographic material which satisfies high sensitivity, $D_{max}$ and drying property even in a short-time developing.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer containing silver halide grains, a surface protective layer as an uppermost layer, and a hydrophilic colloid layer other than said at least one light-sensitive silver halide emulsion layer and said surface protective layer, wherein the sum of the silver amount contained in each of said at least one light-sensitive silver halide emulsion layer is from 0.8 g/m$^2$ to 1.5 g/m$^2$ on one side of said support; said hydrophilic colloid layer other than said at least one light-sensitive silver halide emulsion layer and said surface protective layer contains a non-elusive solid fine grain dispersion dye represented by formula (I); and a mercapto compound represented by formula (II) is contained in at least one hydrophilic colloid layer:

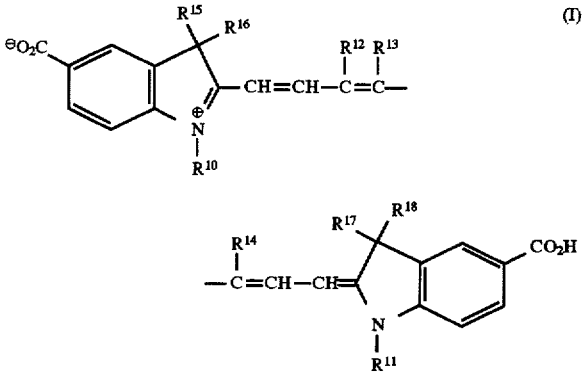

(I)

wherein $R^{10}$ and $R^{11}$ each represents an alkyl group, an aralkyl group or an alkenyl group; $R^{12}$ and $R^{14}$ each represents a hydrogen atom or an atomic group necessary to form a 5- or 6-membered ring by linking with each other; $R^{13}$ represents an aryl group, —N($R^{19}$)($R^{20}$), —S$R^{21}$ or —O$R^{22}$; $R^{19}$ represents a hydrogen atom, an alkyl group or an aryl group; $R^{20}$ represents an aryl group, a sulfonyl group or an acyl group; $R^{19}$ and $R^{20}$ may be linked with each other to form a ring; $R^{21}$ and $R^{22}$ each represents an aryl group; and $R^{15}$, $R^{16}$, $R^{17}$ and $R^{18}$ each represents an alkyl group, and $R^{15}$ and $R^{16}$, and $R^{17}$ and $R^{18}$ may be linked with each other to form a ring;

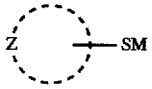

(II)

wherein Z represents a heterocyclic ring having at least one of —$SO_3M$, —$COOR_1$, —OH and —$NHR_2$ bonded directly or indirectly to said heterocyclic ring; M represents a hydrogen atom, an alkali metal atom, or a quaternary ammonium group or a quaternary phosphonium group; $R_1$ represents a hydrogen atom, an alkali metal atom, or an alkyl group having from 1 to 6 carbon atoms; $R_2$ represents a hydrogen atom, an alkyl group having from 1 to 6 carbon atoms, —$COR_3$, —$COOR_3$ or —$SO_2R_3$; and $R_3$ represents a hydrogen atom, an aliphatic group or an aromatic group.

2. The silver halide photographic material as claimed in claim 1, wherein said surface protective layer contains alkali-insoluble synthetic polymer particles represented by formula (III);

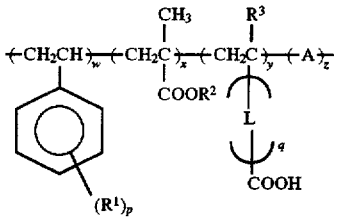

(III)

wherein $R^1$ represents a methyl group or a halogen atom; $R^2$ represents a methyl group or an ethyl group; $R^3$ represents a hydrogen atom or a methyl group; L represents a divalent linking group; A represents an ethylenically unsaturated monomer, provided that two or more double bonds are not contained in one monomer; p represents 0, 1 or 2; q represents 0 or 1; w represents from 3 to 60 mol %; x represents from 30 to 96.5 mol %; y represents from 0.5 to 25 mol %; z represents from 0 to 30 mol %; and w+x+y+z=100 mol %.

3. The silver halide photographic material as claimed in claim 1, wherein said at least one light-sensitive silver halide emulsion layer is sensitized with a selenium compound, and the entire hydrophilic colloid layer present on the same side of said at least one light-sensitive silver halide emulsion layer on said support has a ratio of swelling of 130% to 200%.

4. The silver halide photographic material as claimed in claim 3, wherein 50% to 100% of the total projected area of said silver halide grains is accounter for by for tabular silver halide grains having an aspect ration of 3 to 30.

5. The silver halide photographic material as claimed in 3, wherein the average grain size corresponding to a circle of the projected area of each of said silver halide grains is from 0.1 μm to 0.8 μm.

6. The silver halide photographic material as claimed in claim 3, wherein the silver halide photographic material has a layer containing a non-elusive electrically conductive component.

7. A method for processing a silver halide photographic material with an automatic processor, which comprises imagewise exposing said silver halide photographic material to light and then developing said exposed silver halide photographic material with a developing solution containing (i) a developing agent represented by formula (I') and (ii) no hydroquinones, for 5 to 30 seconds:

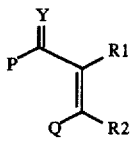

(I')

wherein R1 and R2 each represents a hydroxyl group, an amino group, a mercapto group or an alkylthio group; P and Q each represents a hydroxyl group, a carboxyl group, an alkoxyl group, a hydroxyalkyl group, a carboxyalkyl group, a sulfo group, a sulfoalkyl group, an amino group, an alkyl group or an aryl group, or P and Q each represents an atomic group necessary to form a 5- to 8-membered ring by connecting with each other together with two vinyl carbon atoms substituted with R1 and R2 and the carbon atom substituted with Y; Y represents =O or =N—R3; and R3 represents a hydrogen atom, a hydroxyl group, an alkyl group, an acyl group, a sulfoalkyl group or a carboxyalkyl group; wherein said silver halide photographic material comprising a support having thereon at least one light-sensitive silver halide emulsion layer containing silver halide grains, a surface protective layer as an uppermost layer, and a hydrophilic colloid layer other than said at least one light-sensitive silver halide emulsion layer and said surface protective layer, wherein the sum of the silver amount contained in each of said at least one light-sensitive silver halide emulsion layer is from 0.8 g/m$^2$ to 1.5 g/m$^2$ on one side of said support; said hydrophilic colloid layer other than said at least one light-sensitive silver halide emulsion layer and said surface protective layer contains a non-elusive solid fine grain dispersion dye represented by formula (I); and a mercapto compound represented by formula (II) is contained in at least one of any hydrophilic colloid layer:

(I)

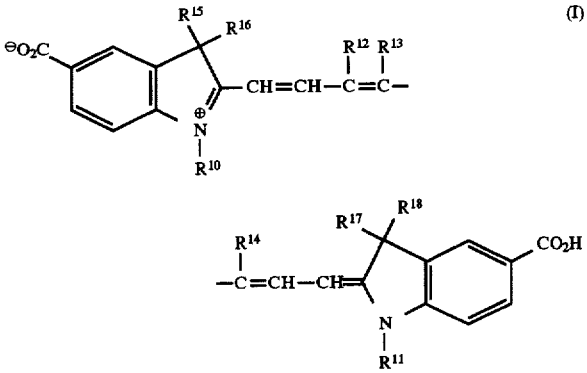

wherein $R^{10}$ and $R^{11}$ each represents an alkyl group, an aralkyl group or an alkenyl group; $R^{12}$ and $R^{14}$ each represents a hydrogen atom or an atomic group necessary to form a 5- or 6-membered ring by linking with each other; $R^{13}$ represents an aryl group, —N($R^{19}$)($R^{20}$), —S$R^{21}$ or —O$R^{22}$; $R^{19}$ represents a hydrogen atom, an alkyl group or an aryl group; $R^{20}$ represents an aryl group, a sulfonyl group or an acyl group; $R^{19}$ and $R^{20}$ may be linked with each other to form a ring; $R^{21}$ and $R^{22}$ each represents an aryl group; and $R^{15}$, $R^{16}$, $R^{17}$ and $R^{18}$ each represents an alkyl group, and $R^{15}$ and $R^{16}$, and $R^{17}$ and $R^{18}$ may be linked with each other to form a ring;

(II)

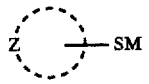

wherein Z represents a heterocyclic ring having at least one of —$SO_3M$, —$COOR_1$, —OH and —$NHR_2$ bonded directly or indirectly to said heterocyclic ring; M represents a hydrogen atom, an alkali metal atom, or a quaternary ammonium group or a quaternary phosphonium group; $R_1$ represents a hydrogen atom, an alkali metal atom, or an alkyl group having from 1 to 6 carbon atoms; $R_2$ represents a hydrogen atom, an alkyl group having from 1 to 6 carbon atoms, —$COR_3$, —$COOR_3$ or —$SO_2R_3$; $R_3$ represents a hydrogen atom, an aliphatic group or an aromatic group.

8. The method for processing a silver halide photographic material as claimed in claim 7, wherein a replenishment amount of said developing solution is from 25 ml to 200 ml per m$^2$ of said silver halide photographic material.

9. The silver halide photographic material as claimed in claim 1, wherein $R^{10}$ represents an alkyl group.

10. The silver halide photographic material as claimed in claim 1, wherein $R^{11}$ represents an alkyl group.

11. The silver halide photographic material as claimed in claim 1, wherein $R^{12}$ and $R^{14}$ form a five- or six-membered ring.

12. The silver halide photographic material as claimed in claim 1, wherein $R^{13}$ represents —N($R^{19}$)($R^{20}$).

13. The silver halide photographic material as claimed in claim 1, wherein $R^{13}$ represents —S$R^{21}$.

14. The silver halide photographic material as claimed in claim 1, wherein $R^{13}$ represents —O$R^{22}$.

15. The silver halide photographic material as claimed in claim 1, wherein $R^{19}$ represents an alkyl group or an aryl group.

16. The silver halide photographic material as claimed in claim 12, wherein $R^{19}$ represents an alkyl group or an aryl group.

17. The silver halide photographic material as claimed in claim 12, wherein $R^{19}$ represents an aryl group.

18. The silver halide photographic material as claimed in claim 12, wherein $R^{19}$ represents a phenyl group.

19. The silver halide photographic material as claimed in claim 12, wherein both $R^{19}$ and $R^{20}$ represent a phenyl group.

20. The silver halide photographic material as claimed in claim 1, wherein both $R^{10}$ and $R^{11}$ represent an alkyl group; $R^{13}$ represents —N($R^{19}$)($R^{20}$), —S$R^{21}$ or —O$R^{22}$; and both $R^{19}$ and $R^{20}$ represent an aryl group.

* * * * *